United States Patent [19]

Kirschner et al.

[11] Patent Number: 5,022,233

[45] Date of Patent: Jun. 11, 1991

[54] ICE BANK CONTROL SYSTEM FOR BEVERAGE DISPENSER

[75] Inventors: Jonathan Kirschner, Powder Springs; William F. Stembridge, College Park; W. Frank Stembridge, III, East Point; Douglas A. Deeds, College Park, all of Ga.

[73] Assignee: The Coca-Cola Company, Atlanta, Ga.

[21] Appl. No.: 402,205

[22] Filed: Sep. 1, 1989

Related U.S. Application Data

[63] Continuation-in-part of Ser. No. 115,935, Nov. 2, 1987, abandoned.

[51] Int. Cl.[5] ..... F25C 1/00

[52] U.S. Cl. ..... 62/138; 62/139; 62/201

[58] Field of Search ..... 62/138, 139, 137, 435, 62/180, 185, 201, 158, 126, 129, 130; 165/12; 361/22

[56] References Cited

U.S. PATENT DOCUMENTS

| | | | |
|---|---|---|---|
| 2,459,337 | 1/1949 | Raney | 62/138 |
| 4,300,199 | 11/1981 | Yoknis et al. | 165/12 |
| 4,437,319 | 3/1984 | Iannelli | 62/138 |
| 4,584,845 | 4/1986 | Hansen et al. | 62/201 |

*Primary Examiner*—Harry B. Tanner

*Attorney, Agent, or Firm*—Thomas R. Boston; W. Dexter Brooks

[57] ABSTRACT

An ice bank control system for a beverage dispenser having a mechanical refrigeration system including an inexpensive solid state sensor, preferably a thermistor, located in the ice water bath adjacent to the evaporator coil and connected to a control circuit including a microprocessor which not only controls the ice bank, but also protects the compressor motor. The resistance of the thermistor is measured and then compared to a reference value previously stored in the microprocessor memory.

6 Claims, 13 Drawing Sheets

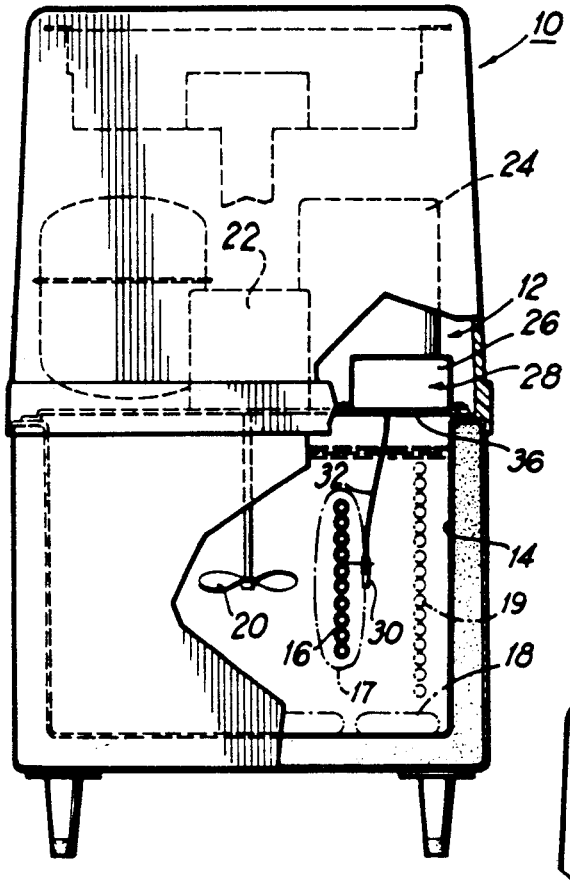
FIG 1
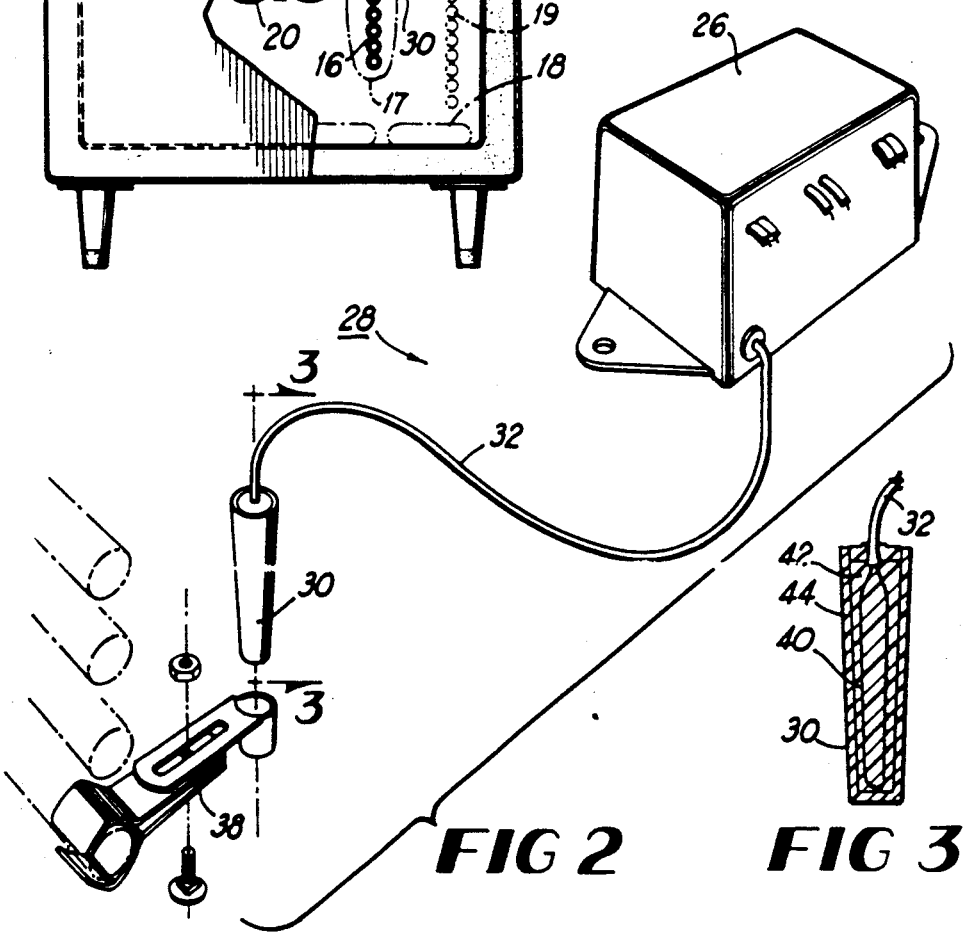
FIG 2
FIG 3

NOTES: 1) ALL RESISTORS .25W UNLESS NOTED OTHERWISE
2) LM 393 POWER; PIN 4, GND; PIN 8, +5V.

LINES 670-702

ICE BANK CONTROL SYSTEM FOR BEVERAGE DISPENSER

CROSS-REFERENCE TO RELATED APPLICATION

BACKGROUND OF THE INVENTION

This is a continuation-in-part application to parent application Ser. No. 07/115,935 filed Nov. 2, 1987, abandoned by the same inventors and having the same title.

This invention relates to an ice bank control system, and in particular to such a system for a beverage dispenser having a mechanical refrigeration system.

Ever since ice banks have been used to maintain a water bath at or near 32 degrees F. surrounding the ice bank, the control systems to maintain the ice bank, for the most part have been metal capsules filled with water. The freezing process caused expansion within the capsule thereby flexing a diaphragm and pushing a fluid in a capillary tube against a piston on the opposite end of the capillary tube to actuate a switch. These systems have been adequate over the years, however, being a mechanical type of system, they have problems of leakage, diaphragm wear, and general mechanical tolerances that sometimes make this type of control irregular in its operation. Since the water inside the capsule on these devices is enclosed, they all tend to overbuild an ice bank on the initial pull down, as the first ice crystal formation does not occur immediately, partially due to having a very slight pressure on the water in the capsule. After the initial pull down, the ice never completely melts within a capsule during normal operation and the temperature cycle becomes very consistent until wear or leakage in the system causes a change that generally builds a larger ice bank until complete failure, at which time, the water within the ice bank container completely freezes. To replace the control necessitates waiting for the ice to melt. In addition, when the ice bank container freezes completely, damage often occurs to the more expensive stainless steel water and syrup cooling coils, requiring replacement thereof.

SUMMARY OF THE INVENTION

The present invention encompasses more than just controlling the thickness of the ice bank; it also includes protection for the compressor. The present invention uses a solid state sensor that has proven to be very reliable to measure the temperature of the super cooled ice. This system can maintain a very consistent ice bank within the capacity of the compressor system.

The ice bank control system of this invention is for use in a mechanical refrigeration system of a beverage dispenser, and comprises a sensor (or probe) located in the ice water bath tank adjacent to the evaporator coil, a control circuit including a microprocessor located above the ice water bath tank, and a low cost relay for turning the compressor on and off. The sensor is an inexpensive solid state sensor, preferably a thermistor. The microprocessor is preferably a single chip microcomputer. The microprocessor is programmed to not only control the ice bank, but also to: (1) maintain the compressor off for a period of time, each time it is turned off, to allow high and low pressure equalization to reduce the risk of compressor motor burnup; (2) shut off the compressor to prevent an overfreeze whenever either a short circuit or an open circuit occurs in the solid state sensor; (3) control the agitator motor including keeping it off whenever the water temperature is above a certain temperature, such as 60 degrees F., to reduce the risk of burnup of the compressor motor; (4) prevent overbuild of the ice bank during the initial icebank buildup, which can prevent freeze up of the syrup and water lines; (5) reduce the number of calls required to repair a failure; and (6) provide a "watchdog" circuit that turns the compressor off in the event of an unusual spike or wave form.

It is an object of the present invention to overcome the above-mentioned problems in the prior art and to provide an improved ice bank control system.

It is a further object of this invention to provide an ice bank control system that is fail safe, that is, when it fails, it shuts off the compressor.

It is another object of the present invention to provide a closer control on the ice bank size.

It is a further object to provide an ice bank control system that does not require the presence of a tube of fluid extending into the ice bath.

It is another object of the invention to provide an ice bank control that controls the agitator.

It is another object of this invention to provide an ice bank control system using an inexpensive solid state sensor.

It is another object of this invention to provide an ice bank control system using a solid state sensor, a microprocessor and a relay.

It is a still further object of this invention to provide an ice bank control system that controls not only the ice bank but that also: (1) maintains the compressor off for a period of time, each time it is turned off, to allow high and low pressure equalization to reduce the risk of compressor motor burnup; (2) shuts off the compressor to prevent an overfreeze whenever either a short or an open circuit occurs in the solid state sensor; (3) controls the agitator motor including keeping it off whenever the water temperature is above a certain temperature, such as 40 degrees F., to reduce the risk of compressor motor burnup (4) prevents overbuild of the ice bank during the initial icebank buildup, which can prevent freeze up of the syrup and water lines; (5) when built in large quantities, is less expensive than previous systems while providing additional features such as protecting the compressor and reducing the number of failures and the number of calls required to repair a failure; and (6) includes a "watchdog" circuit that turns the compressor off in the event of an unusual spike or wave form.

It is another object of this invention to provide an ice bank control system using an inexpensive thermistor, the resistance of which is measured and then compared to a reference value previously stored in the microprocessor memory.

BRIEF DESCRIPTION OF THE DRAWINGS

The present invention will be more fully understood from the detailed description below when read in connection with the accompanying drawings wherein like reference numerals refer to like elements and wherein:

FIG. 1 is a partly-cross-sectional rear elevational view of a beverage dispenser using the ice bank control system of this invention;

FIG. 2 is a perspective view of the sensor, control housing and support bracket for the sensor;

FIG. 3 is a cross-sectional view through the sensor;

DETAILED DESCRIPTION OF THE PREFERRED EMBODIMENTS

Figure 4:
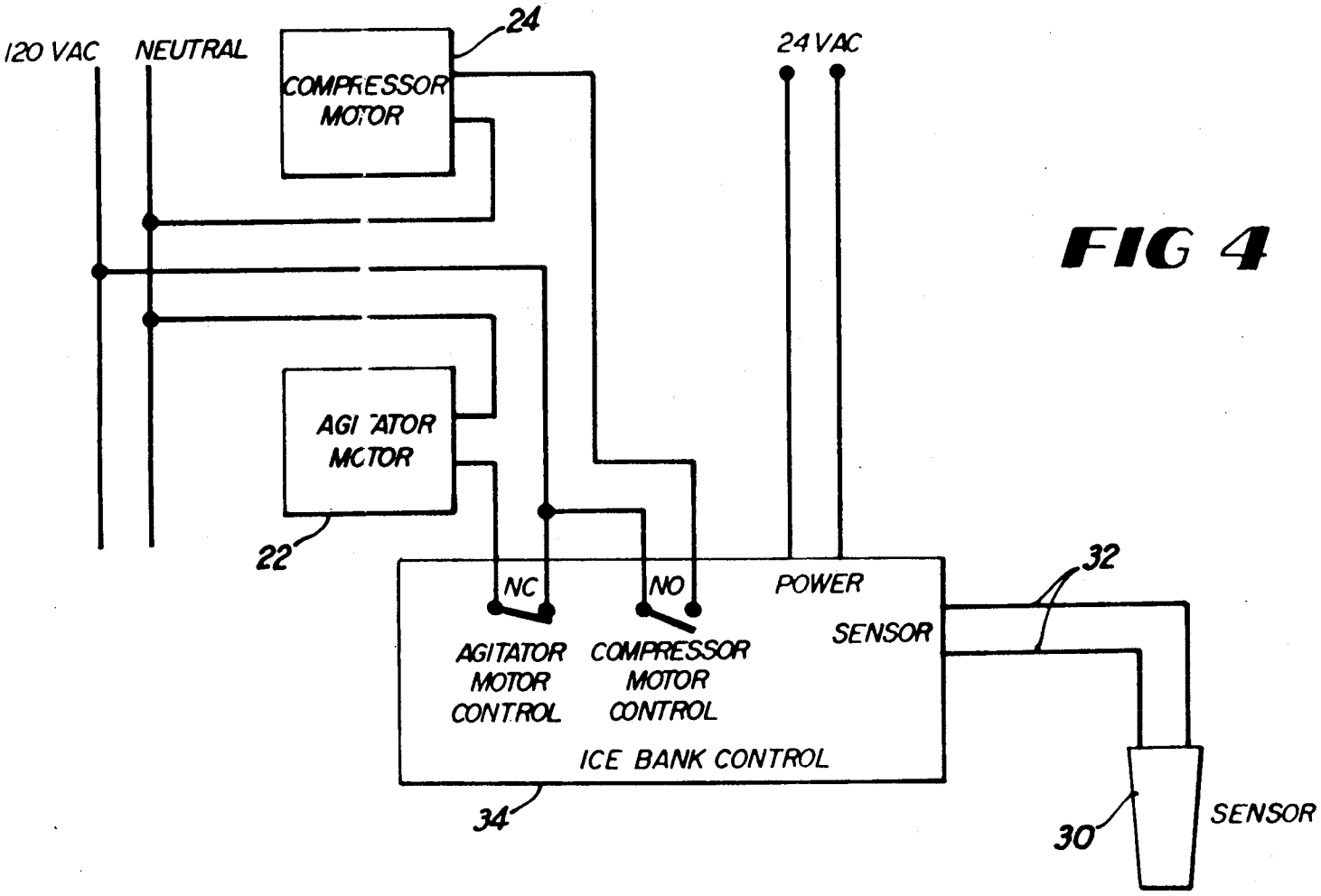
FIG. 4 is an electrical block diagram of the control circuit.

With reference now to the drawings, FIG. 1 shows a beverage dispenser 10 having a mechanical refrigeration system 12 including an ice water bath tank 14, evaporator coils 16 positioned in the tank 14 to build an ice bank 17, syrup cooling coils 18 water cooling coils 19, an agitator 20, an agitator motor 22, a compressor system including a compressor motor 24 and a control box 26 housing an ice bank control system 28. The ice bank control system 28 of the present invention can be used with any standard well-known refrigeration system. It is therefore, not necessary to describe in detail such known refrigeration system.

Referring to FIGS. 1-3, the ice bank control system 28 of this invention comprises a sensor 30 connected by an insulated and shielded electrical line 32 to the ice bank control system mounted above the water on a refrigeration deck 36. The sensor 30 is mounted in the ice water bath at the desired predetermined distance (usually one to two inches) from the evaporator coil 16, by a support bracket 38 connected to a coil. The distance depends upon the type and size of the particular dispenser, the amount of weight of ice the coils 16 are designed to carry, and the desired thickness of the ice bank. The bracket 38 can provide for adjusting the distance of the sensor 30 from the coil. The sensor 30 is preferably an inexpensive solid state sensor such as a highly repeatable thermistor sensing element 40 encased in a quantity of epoxy material 42 inside a watertight plastic (preferably Lexan) shell 44.

The sensor 30 is preferably placed at the desired location for the boundary between the ice and the water. In previous systems, the ice bank would vary in size from about one inch beyond the sensor to one inch short of the sensor. The present invention keeps the ice bank at essentially the same size all the time. When the compressor is on, the temperature at the sensor will continually drop, and while the compressor is off, the temperature at the sensor will continually increase. Various selected temperatures can be selected for the sensor to turn the compressor off and on, that is, for a second higher temperature, respectively. A preferred first temperature is 29.5° F. for all but the first pulldown cycle (which is 27° F.), and is preferably 31.5° F. for the second temperature.

This invention uses a probe containing one sensor. One sensor can be used to measure actual temperature and compare it to a reference temperature. This invention compares the sensor temperature with 31.9 degrees. When the sensor goes down to 27° during the first pulldown and 29.5 on all subsequent pulldowns the compressor will cycle off. When it rises to equal 31.5° it will cycle on. This works well because the first ice formation can occur at temperatures as low as 27° F. Therefore, 27° is used first to ensure ice formation. Once ice is developed however the sensor will be one half buried in ice and will be able to detect 29.5° F. When the sensor hits 31.5° F. it must then be just touching the water.

In one alternative embodiment, instead of going to 27° F. during the first pulldown to ensure ice formation, the unit senses several minutes at 32°. The reason is that once ice is formed, the bath temperature will hold steady at 32° F. for a long time before ice builds to encapsulate the sensor.

Another aspect of this invention is that inexpensive thermistors are used to minimize the cost of the unit. However, this presents the problem that individual thermistors vary from one to the next in their physical properties, such as their resistance at the same temperature. To solve this problem, each unit is separately calibrated in that the thermistor is placed in a water bath of known temperature, such as 32° F., and its resistance is measured and inputted to the memory of the microprocessor. Since the relationship between the temperature and the resistance of the thermistor is linear, this must be done at only one temperature. Then, during operation, the resistance of the thermistor is measured and compared to this value, which the microprocessor has been told is 32° F., for example.

Figure 5A:
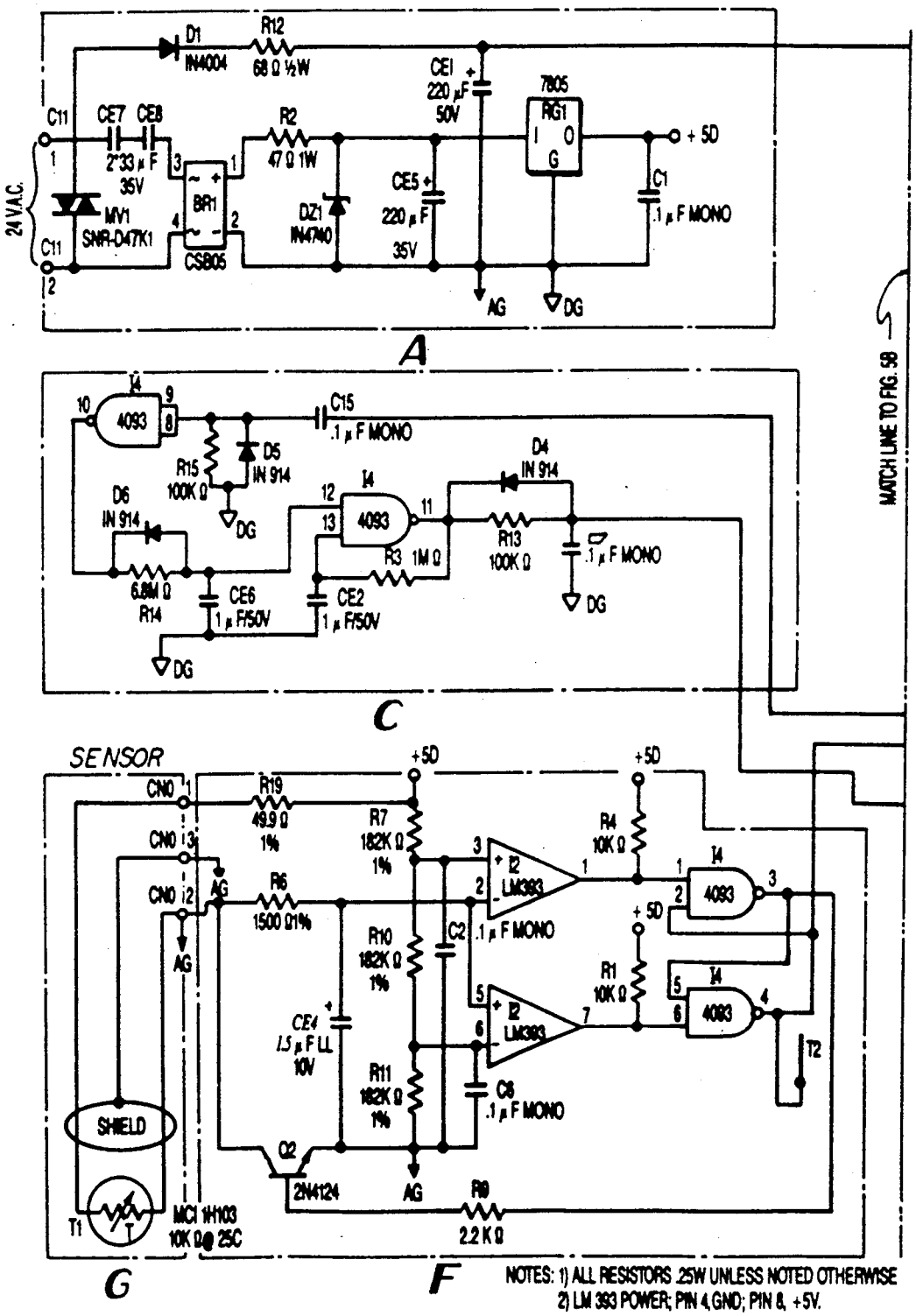
FIGS. 5A and 5B are an electrical schematic circuit diagram of the ice bank control circuit.
Figure 5B:
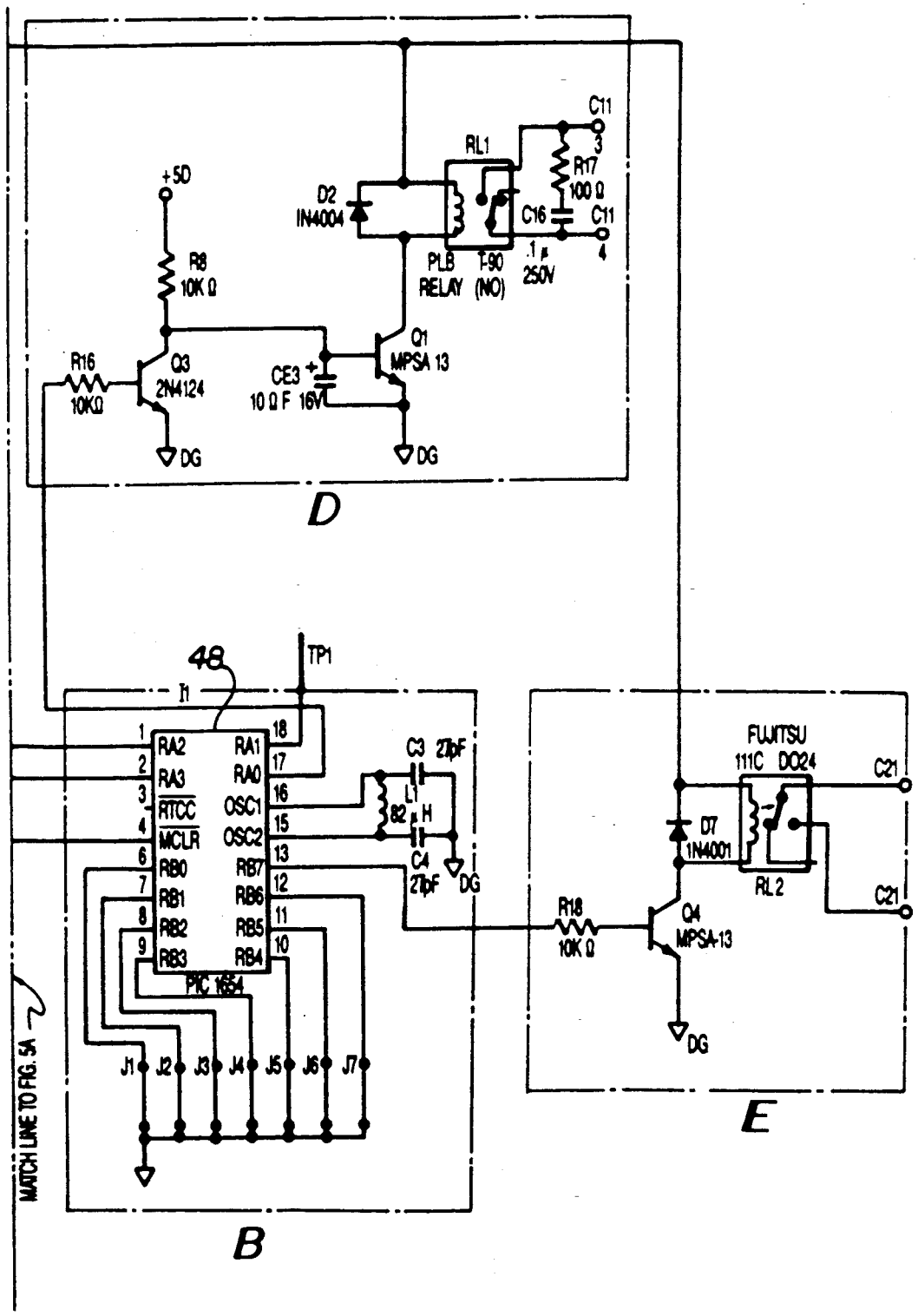
Figure 6A:
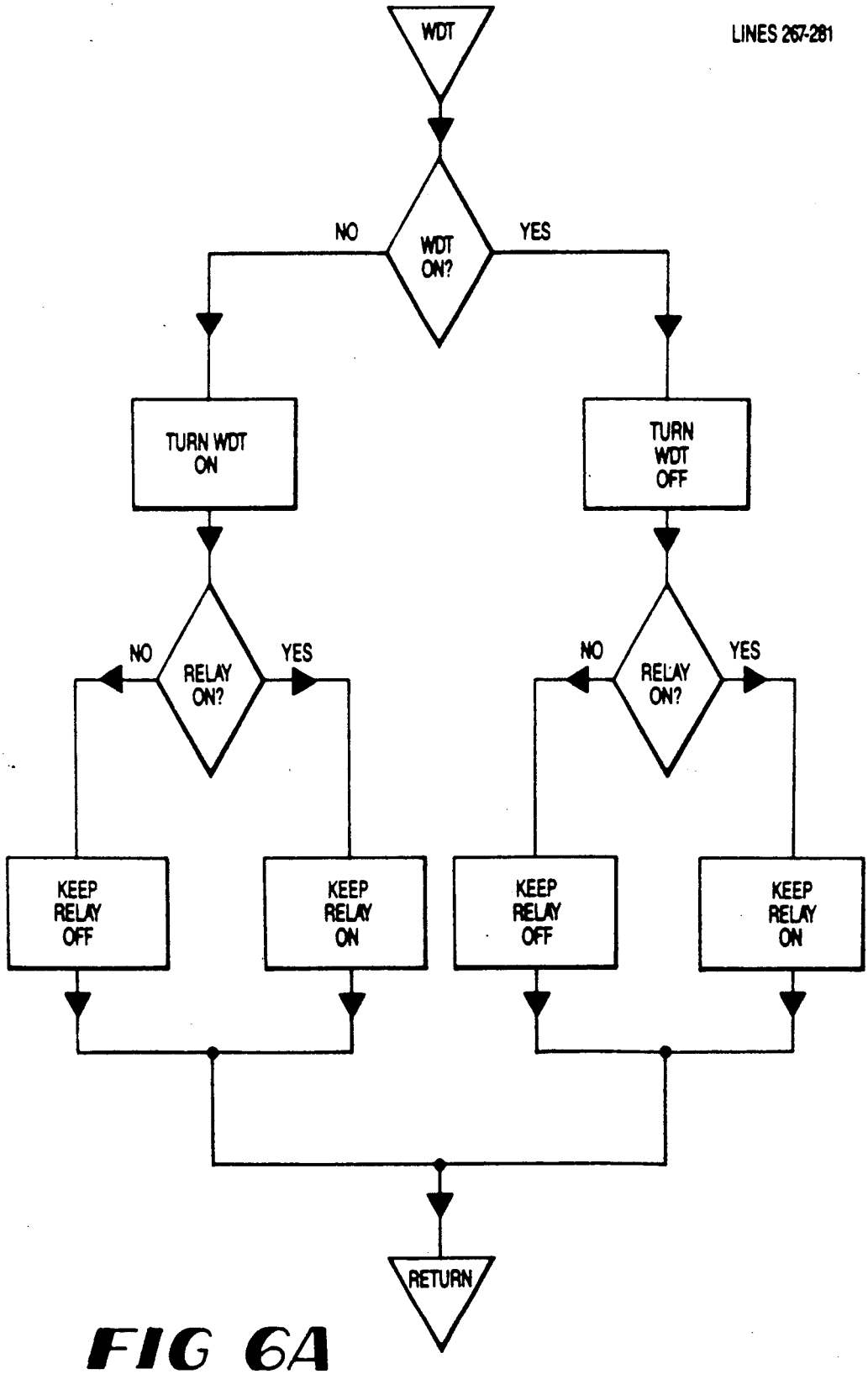
FIGS. 6A-6J are a flow diagram of the software.
Figure 6B:
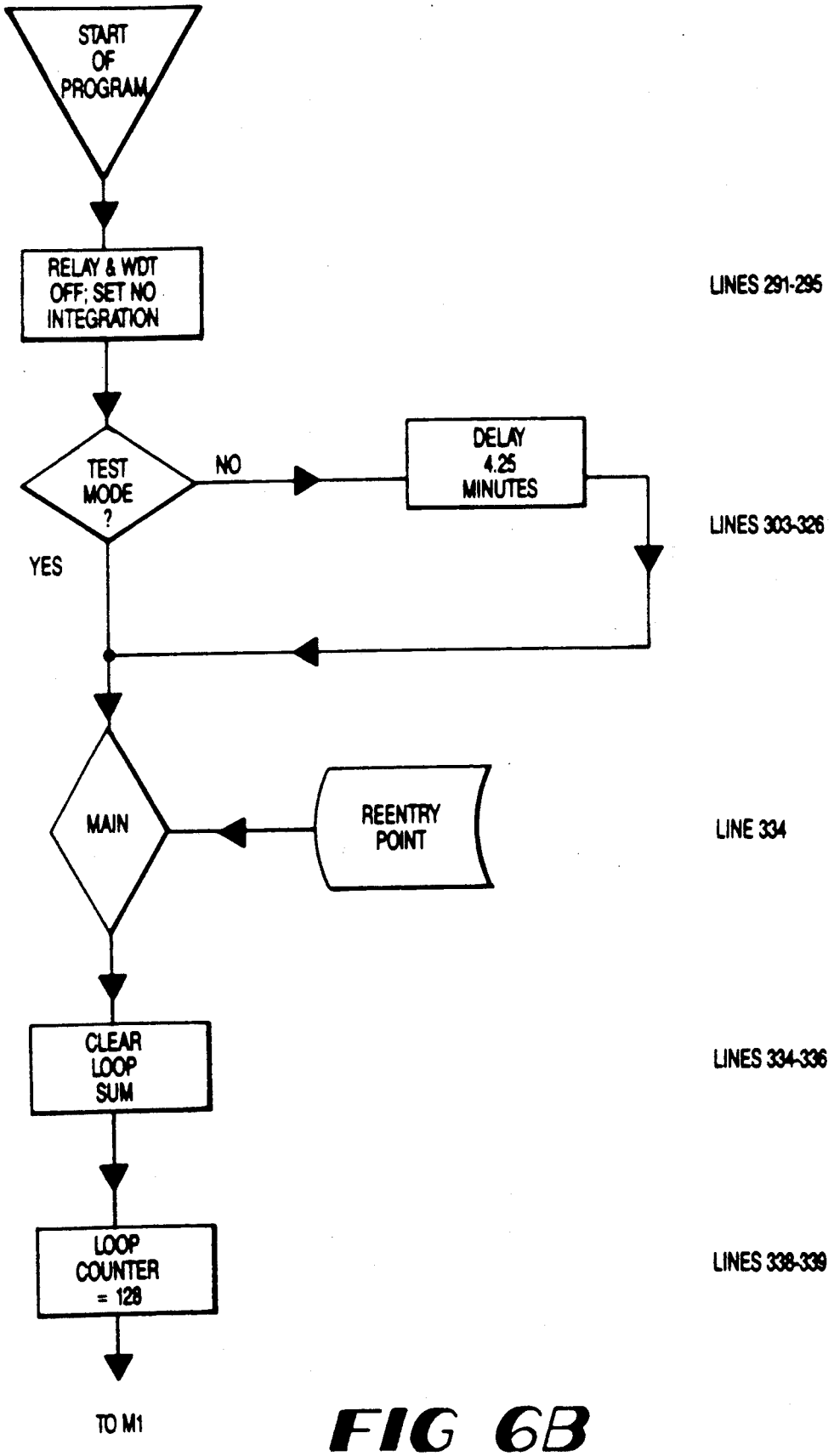
Figure 6C:
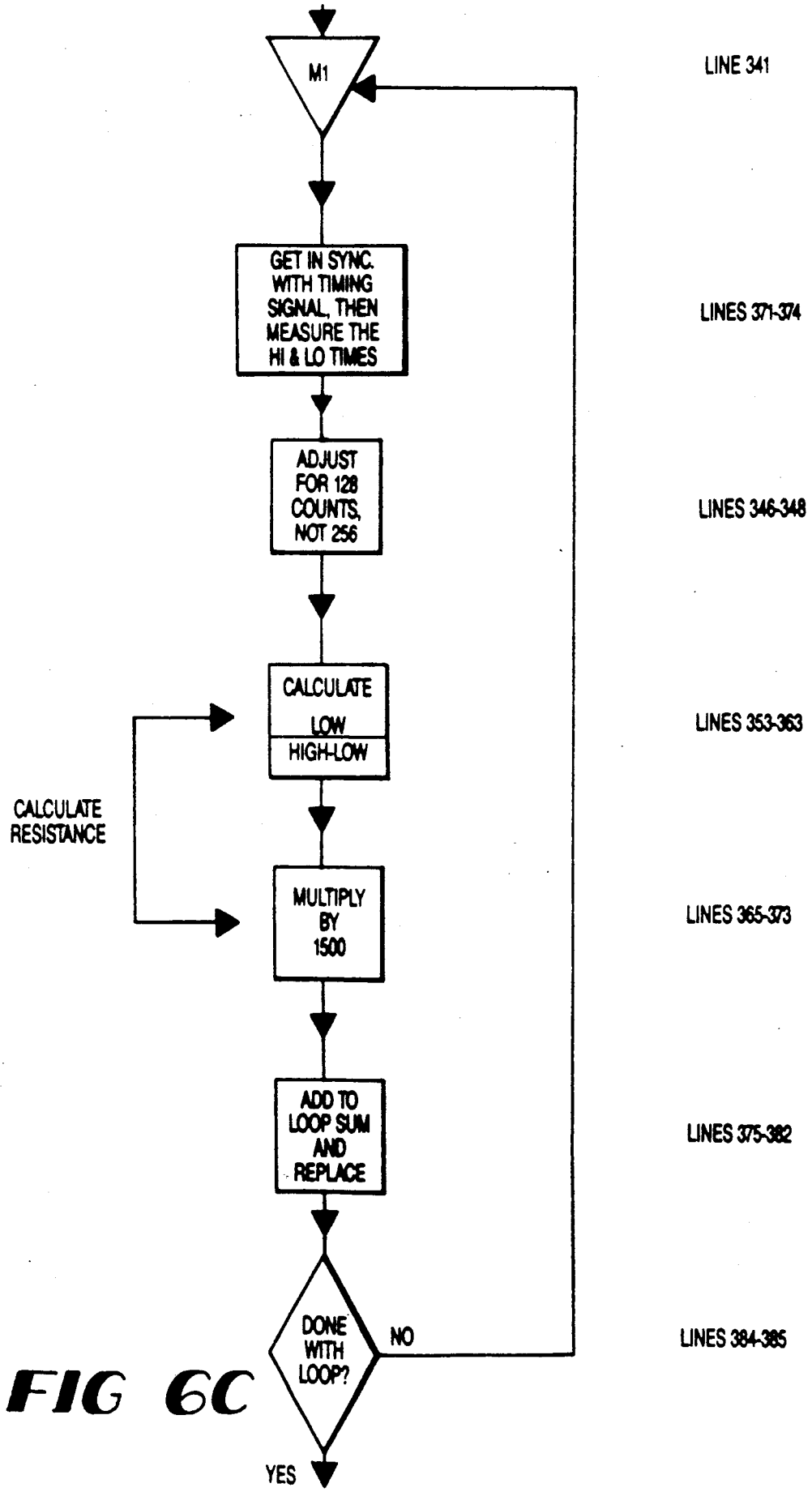
Figure 6D:
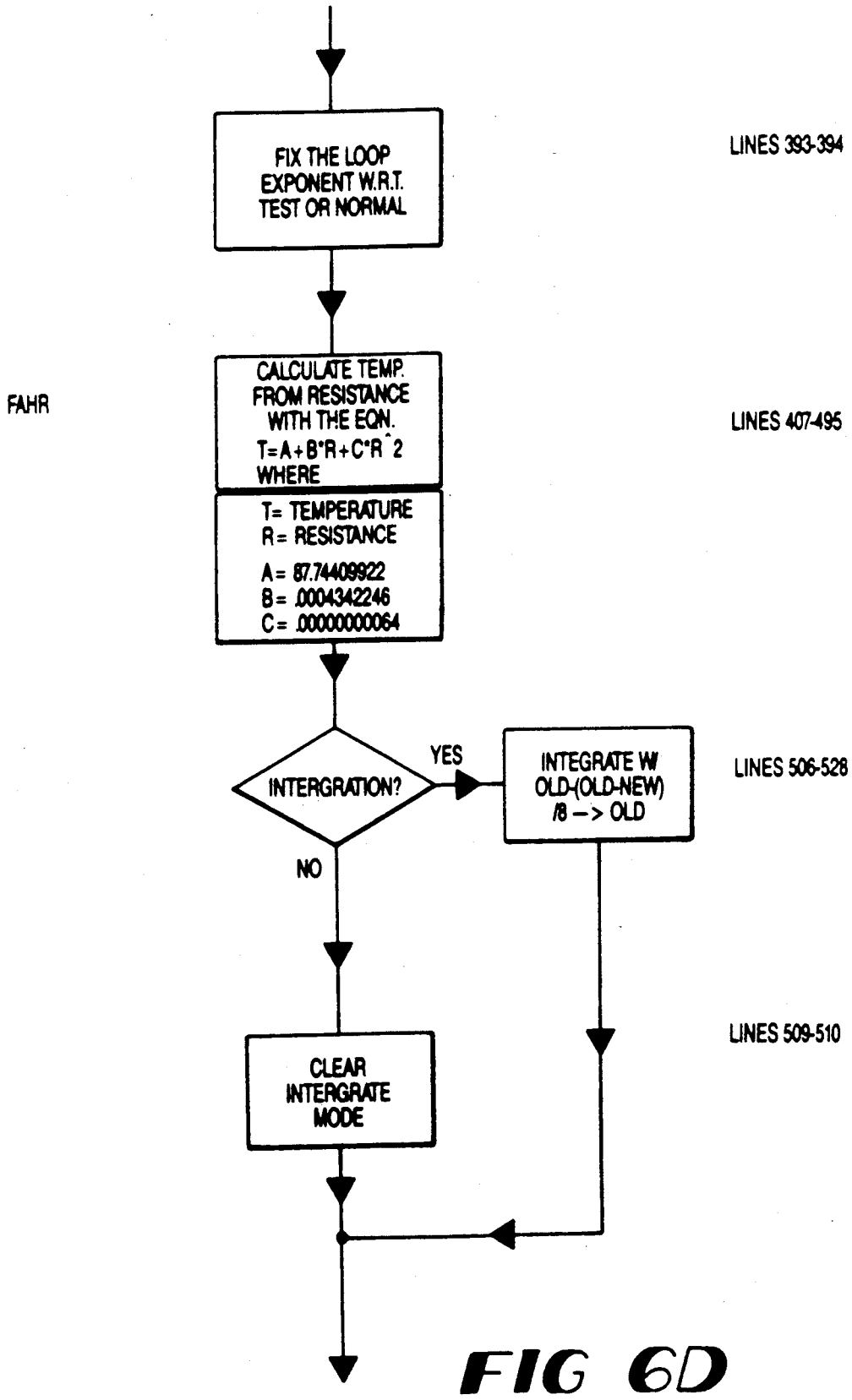
Figure 6E:
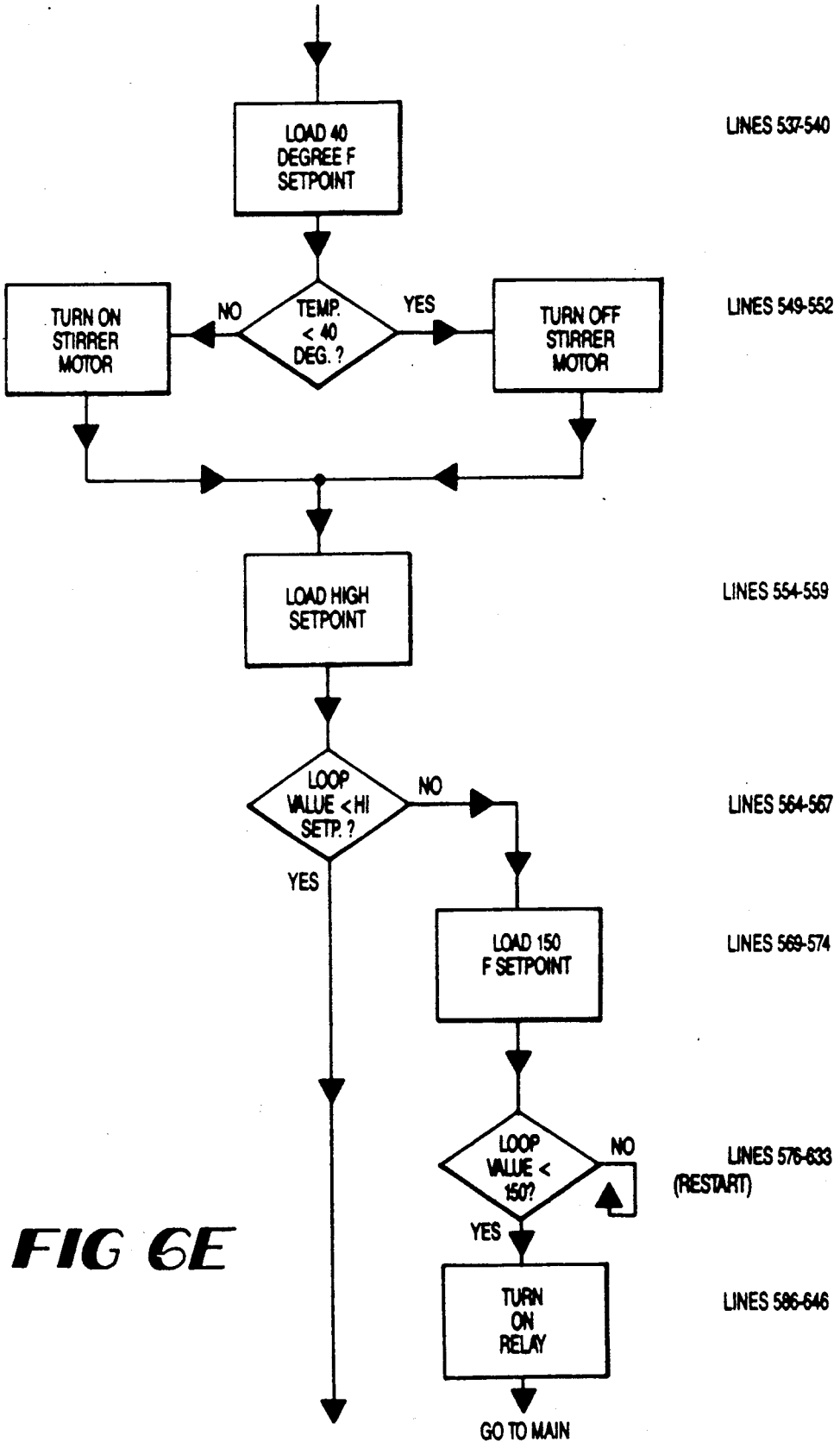
Figure 6F:
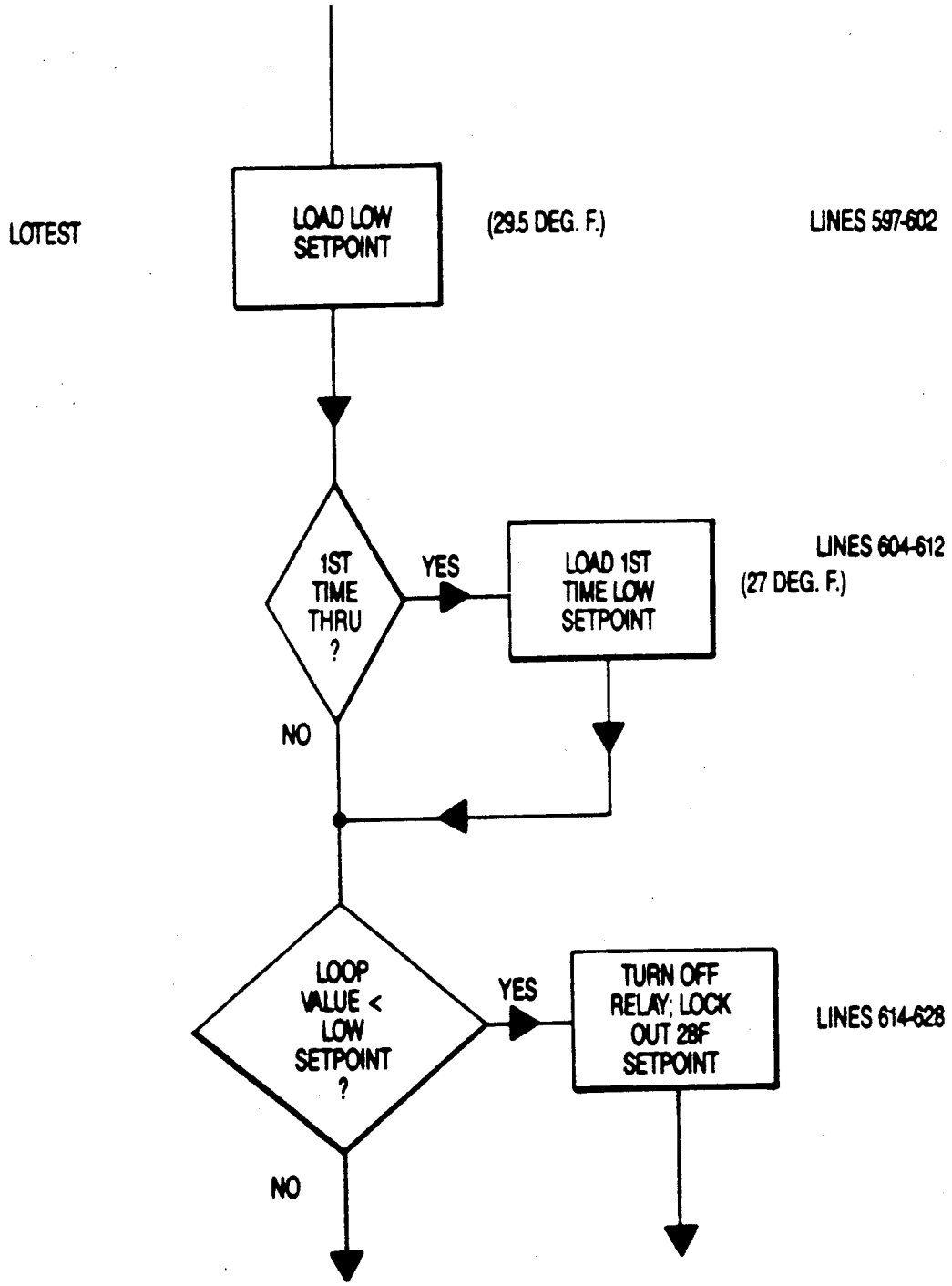
Figure 6G:
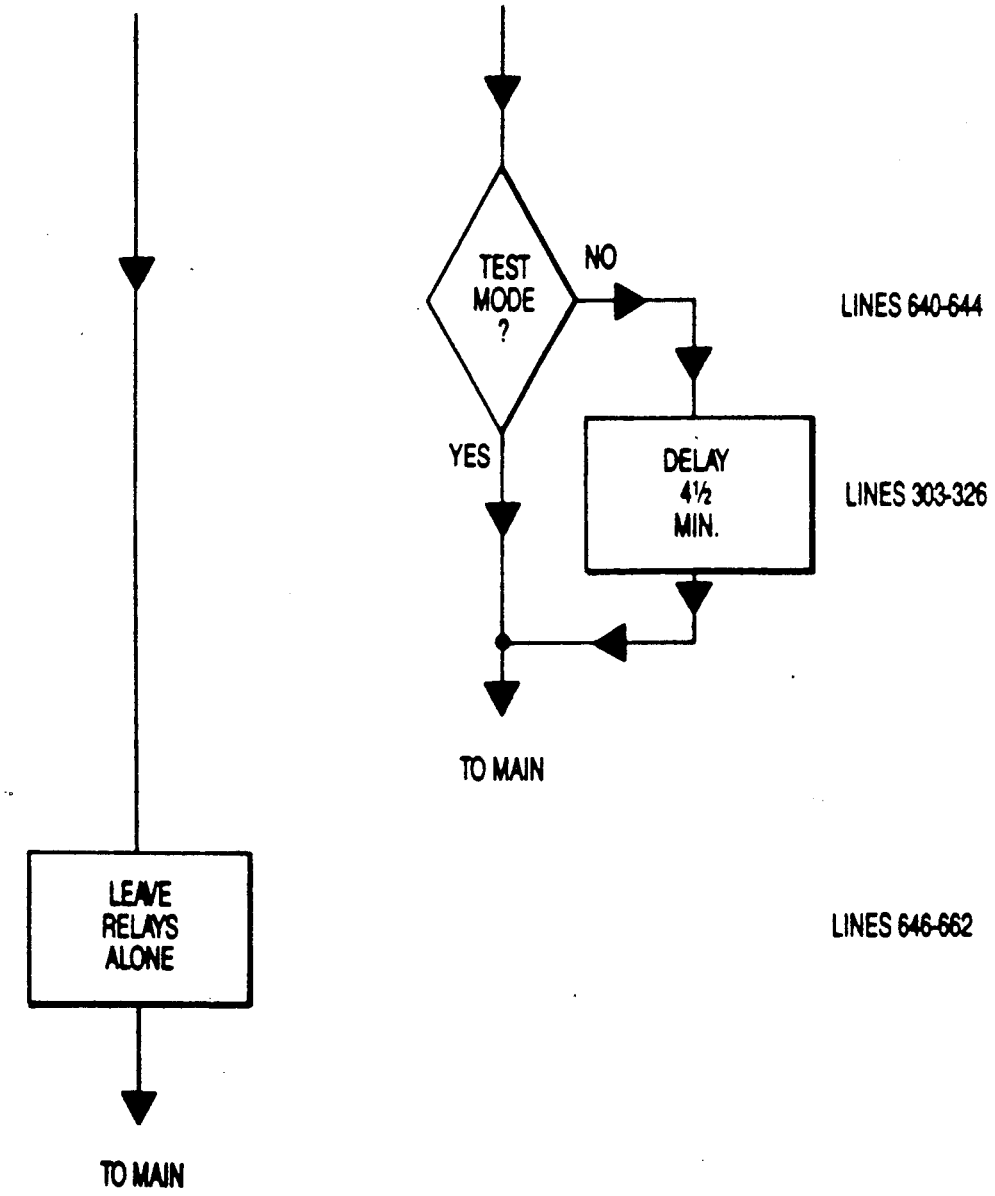
Figure 6H:
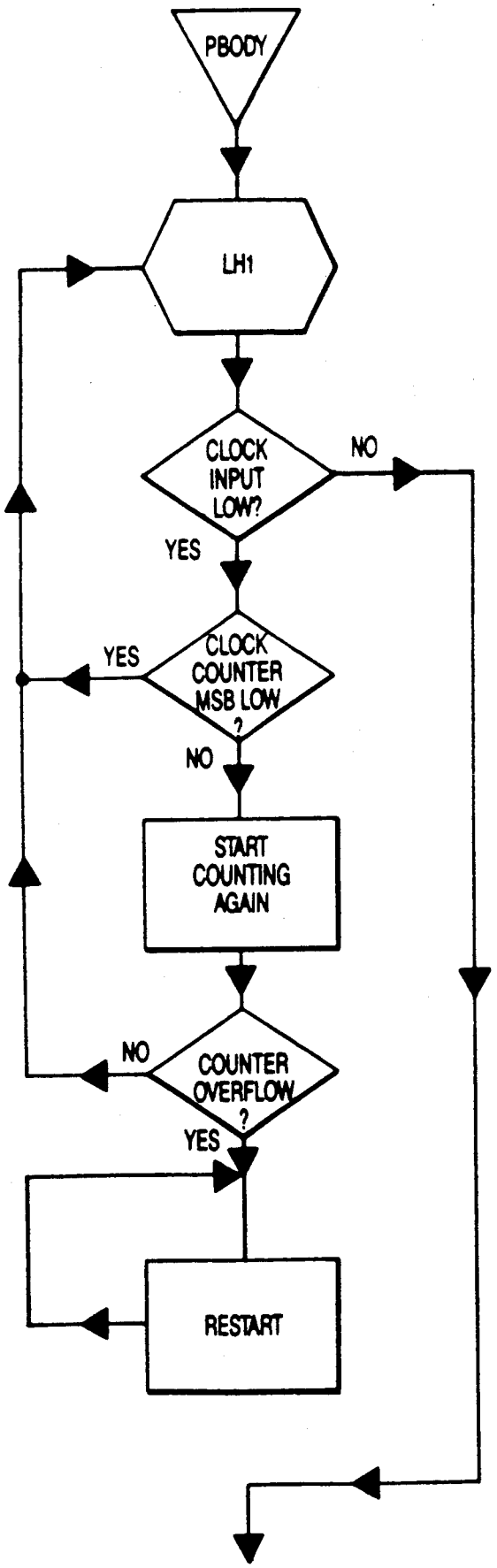
Figures 6I, 6J:
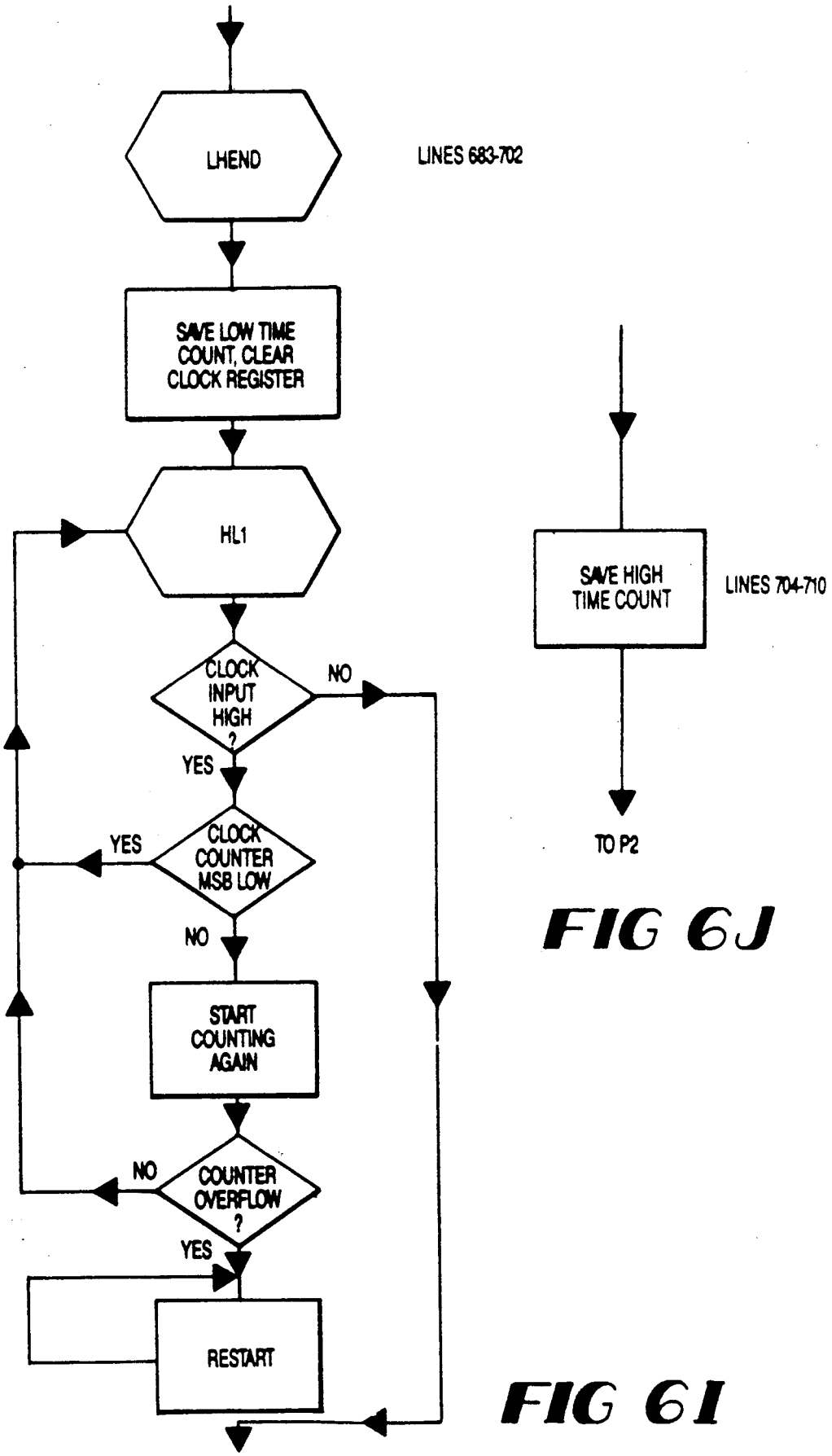

With reference now to FIGS. 4 and 5A and 5B, the electric schematic of the ice bank control system 28 of the present invention will now be described. FIG. 4 shows in block diagram the ice bank control circuit 34 connected to the sensor 30. The ice bank control circuit 34 is connected to both the agitator motor 22 and to the compressor motor 24. FIGS. 5A and 5B are a more detailed electrical schematic diagram of the ice bank control circuit 34, which diagram has been divided up by dotted lines in the into seven separate sections A-G for ease of description.

Regarding section A, the power supply converts 24 VAC into 24 VDC to supply the relays and into regulated 5 VDC to supply the analog and digital logic circuits. MV1 is a varistor which protects the circuitry in the event more than 47 volts is applied. CE7 and CE8 provide a voltage drop for the AC voltage to the bridge rectifier. The output of the bridge is preregulated by R2 and DZ1 and filtered by CE5. This voltage is the input to RG1 which provides +5 VDC to all the analog and logic circuitry. D1 rectifies the AC input voltage to provide 24 VDC. R12 limits the current to the relays.

Regarding section B, I1 is a complete 8 bit single chip microcomputer 48 with 512 program steps and 32 bytes of RAM. It has an 8 bit counter and 12 input/output pins. L1, C3, and C4 provide a 4 MHZ resonator to the oscillator inputs of the microcomputer. J1, J2, J3, J4, J5, J6, and J7 are wire jumpers which are connected between I/0 pins on the microcomputer and ground. Some of the wires will be cut during calibration to one of 128 different patterns.

Regarding section C, the watchdog timer is a circuit that provides power on reset for the microcomputer and monitors the operation, forcing the microcomputer to reset if it detects the output pin not changing "states" for as long as eight seconds. C15, D5, and R15 differentiate the watchdog strobe output of the microcomputer 48, which is implemented with software and an output pin. This signal is buffered with one of the gates of I4 and is the input trigger for the 8 second retriggerable timer made up by D6, R14, and CE6. If the differentiator does not receive pulses, then the timer times out, and the output of the timer is the input gate signal to the gated oscillator made up of CE2, R3, and one of the gates of I4. When the gated oscillator starts to oscillate, the output resets the microcomputer 48 through R13, C7, and D4. The oscillator will continue to reset the microcomputer until the watchdog strobe output begins to trigger the timer.

Regarding section D, the compressor control circuit takes the logic level output of the microcomputer 48 and drives a normally open dry contact relay output. The microcomputer outputs a logic "1" to open the contacts and a logic "0" to close the contacts. Transistor Q3 and resistors R16 and R8 invert the logic output. CE3 filters the output of the inverter to keep the relay off during transients. Darlington transistor Q1 drives the coil of RL1. D2 protects the circuitry from the inductive switching transients. R17 and C16 provide damping for the contacts of the relay during switching.

Regarding section E, the agitator control circuit takes the logic level output of the microcomputer 48 and drives a normally closed dry contact relay output. The microcomputer outputs a logic "1" to open the contacts and a logic "0" to close the contacts. Darlington transistor Q4 and resistor R18 drive the coil of RL2. D7 protects the circuitry from the inductive switching transients.

Regarding section F, the precision oscillator changes the output wave form with changes in the resistance of the sensor input. The output wave form is analyzed by the microcomputer 48 to obtain temperature and component drift information. The circuit generates a wave form of which one part is proportional to the temperature, and one part is proportional to a reference. R7, R10, and R11 form a precision voltage divider with outputs of 1.67 VDC and 3.33 VDC. C2 and C6 filter the outputs of the divider which are input to two precision analog voltage comparators contained in I2. The comparators are connected in a circuit where if the voltage of the other inputs to the comparators are between 1.67 and 3.33 VDC the outputs of the comparator are logic "1" S. R1 and R4 are the pullups for the comparators. If the voltage of the other inputs become greater than 3.33 or less than 1.67, the output of one of the comparators will be "0". The comparators outputs are the set and reset inputs for the "nand latch" made up of 2 gates of I4. When the voltage exceeds the boundaries set up by the voltage divider, the nand latch will change states. One output of the nand latch is input to the microcomputer 48. The other output drives switching transistor Q2 through resistor R9. The other input to the comparators is the voltage on capacitor CE4, which will be charging or discharging through R6 depending on the state of Q2. When CE4 is charging, Q2 will be off and the 5 VDC supply will charge CE4 through the "short circuit resistor" R19, the sensor resistance and R6. When the voltage on CE4 exceeds 3.33 VDC, the comparator output will cause the latch to change states, turning Q2 on and begin to discharge CE4 through R6 only. When the voltage on CE4 drops below 1.67 VDC, the comparator output will cause the state of the nand latch to change again.

Regarding section G, T1 is a negative temperature coefficient thermistor whose resistance changes with temperature in a repeatable manner.

We have documented the temperature gradient of the ice bank with a chart recorder by placing sensors on the evaporator coil and at ⅛ inch intervals up to 1.5 inches away from the coil. The chart clearly shows a temperature gradient through the ice bank 46 that, when operating normally, ranged from approximately 25 degrees F. to 32 degrees F. at the evaporator coil at the time the compressor 24 shut off.

By carefully studying the temperature gradient of the ice bank 46 during normal cycling, we discovered that a temperature pattern existed that could be duplicated using a very accurate temperature measurement system. We determined that a low cost thermistor having a consistent Beta curve where Beta is equal to the semiconductor material and manufacturing process of the thermistor 40, coupled with a single chip microcomputer 48 and a relatively low cost relay RL1 can be employed to maintain the ice bank 17, with more consistency and with additional features over the previously used system.

The system of the present invention includes a low cost highly repeatable thermistor sensing element 40 coupled with a single chip microcomputer 48 to control temperature within 0.05 degrees F. over a very narrow temperature span extending from about 29.5 to about 31.845 degrees.

The thermistor 40 was selected because it maintained a Beta curve of plus or minus 1.2% at a temperature range near 32 degrees F., which variation is almost negligible over the narrow span at the near freezing temperature range within which we are operating.

Differences between actual thermistor Beta Curves and the ideal Beta curve for this thermistor appear as offsets, which are calibrated out by comparing the unit to the ideal at a fixed temperature. Correction is set digitally to avoid problems such as drift over the lifetime of adjustment potentiometers.

In most applications, thermistors are used by measuring voltage across a resistive divider and converting to digital values using a discrete or monolithic analog-to-digital converter. We use the thermistor as one component of a two resistor, one capacitor oscillator. The time of the low state of the oscillator is dependent only on the values of a fixed resistor 54 and the capacitor 56. The time of the high state of the oscillator is dependent on the values of the thermistor 40, the fixed resistor 54 and the capacitor 56.

| | |
|---|---|
| Time Low = | K × RF × C |
| Time High = | K × (RF + RT) × C |
| Where: RF = | Value of Fixed Resistor |
| C = | Value of Capacitor |
| RT = | Value of Thermistor Resistance |
| K = | Constant |

By measuring the period of the High and Low states of the oscillator 52, we can calculate the resistance of the thermistor 40.

Solving for RT:

$$RT = [(RF \times \text{Time High})/\text{Time Low}] - RF$$

Since the value of the capacitor is not used in the calculation of the RT, the value of the capacitor and any temperature drift is not too critical. The temperature drift of the fixed resistor is specified to be negligible.

We took the normalized temperature resistance characteristic over a small range and selected coefficients for a second order polynomial approximation which is accurate to 0.01 degrees F. The microcomputer 48 measures the periods and computes the temperature.

The thermistor 40 is much like other temperature sensors in that they typically, in a single thermistor version, do not have a linear output that coincides with a linear temperature line. The resistance output is a curve which has to be compensated for in order to have accurate measurements. We have created a formula that is included in software for the microprocessor 48 to perform this function.

Since the microprocessor 48 has control of the relay (switch RL1 in FIG. 5D) that controls the compressor motor 24 and since it has the capability of sensing other temperatures and timing functions, we included in the software the following features to further enhance the capability of the icebank control system 28 of this invention:

(a) A 4½minute timer (other time periods could be used) that ensures that the compressor 24 will stay off for 4½minutes each time it is turned off to allow the high and low pressure sides of the compressor 24 to equalize prior to restarting, to keep the compressor motor from trying to start under a heavy load. This feature can substantially reduce compressor motor burnup.

(b) The microcomputer 48 with its software can sense that when the resistance goes to infinity, an open circuit has occurred meaning that a wire has been cut in the sensing circuit thereby causing the microprocessor 48 to shut the compressor 24 off to keep from freezing the water in the tank 14.

(c) The microprocessor 48 also senses that when the resistance goes to virtually zero that a short has occurred in the sensing system and again shuts the compressor 24 off to prevent an overfreeze.

(d) The microprocessor 48 also senses that when the compressor relay RL1 is closed and the water temperature is high, the microprocessor can control a second relay which controls the water circulation motor. By stopping the agitation of the water around the evaporator coil 16, it allows the ice formation to begin much quicker, thereby allowing the compressor pressure differential from increasing too much, which keeps the compressor motor from overheating and burning up. The software programs the microprocessor 48 to keep the agitator motor 22 off anytime the temperature is above approximately 40 degrees F.

(e) Factors such as atmospheric pressure, chemical or mineral content of water, and the amount of stirring in an ice bath can depress the initial freezing temperature to as low as 27.5 degrees F. Since this is below the normal cycling temperature needed to maintain the ice bank, the microprocessor 48 lowers its 29.5 degree F. lower cycle temperature to 27 degrees F. for the first cycle to ensure that the compressor does not turn off during the first ice formation until the ice bank 46 is built.

(f) When produced in large quantities, this system with all its extra benefits is a more accurate and cost effective solution to maintaining ice banks and protecting the compressor motor than other systems available on the market.

(g) The software includes a "watchdog" circuit 60. This feature shuts the microprocessor 48 down, which turns the compressor motor 24 off in the event of an unusual spike or wave form temporarily disrupts the operation of the microprocessor 48. The circuit continuously tries to restart the microprocessor until it sees the proper wave form. When the microprocessor begins to function again, the compressor motor 24 stays off for 4½ minutes.

The software will be understood by one skilled in the art from the flow chart shown in FIG. 6 and from the following software description.

Floating Point Math Package:

| | |
|---|---|
| Sub. FSUB | Subtracts a floating point number in floating point register A from a floating point number in floating point register B with the result going to B. |
| Sub. FADD | Adds the two floating point numbers in registers A and B with the result going to B. |
| Sub. FMPY | Multiplies the floating point numbers in registers A and B with the result going to B. |
| Sub. FDIV | Divides the floating point number in B by the floating point number in A with the result going to B. |
| Sub. NEGA | Negates the floating point number in A with the result staying in A. |
| Sub. NORM | NORM normalizes a floating point number in B so that its most significant bit in the mantissa is a 1. |
| Sub. FSWAP | FSWAP exchanges the contents of floating point registers A and B. |

Coke Ice Detector:

| | |
|---|---|
| Sub. period | Branches to code, pbody, in upper half of memory. This allows it to be called as a subroutine but not use much subroutine memory (lower 128 bytes). |
| Sub. FIXA | FIXA repairs the mantissa of floating point register A with regard to the counting scheme used by period, period counts within a 16 bit pseudoregister but the upper B bits has the value of 128 not 256 as with a normal 16 bit number. FIXA divides the upper 8 bits by 2, then adds 128 to the bottom 8 bits if the top 8 was not evenly divisible by 2. |
| Sub. movbw | movbw moves a floating point number in floating register B to the floating point register whose number is in W at the onset of the CALL. |
| Sub. movwb | movwb moves a floating point number whose file number is in W at the onset of the CALL to floating point register B. |
| Sub. wdt | wdt prevents the constant re-initialization of the microprocessor by the watch dog hardware, during normal operation. It does this by toggling the wdog line whenever called. The resulting pulses keep capacitor CE3 discharged, thus preventing the connected section of IC2 from oscillating and resetting the 1654. |

The MAIN Program:

| | |
|---|---|
| beginning (no label) | This clears all registers for startup. This section does simple initialization then delays for 2.2 seconds or 4.5 minutes (test or normal modes). |
| MAIN | This section takes 128 samples, calculates the resistance of each individually and keeps a running sum. |
| fixexp | fixexp averages the sum by correcting its exponent. In effect dividing by 128. |
| fahr | fahr calculates the temperature from the input resistance from the formula $T = A + Br + Cr^2$ where T is the temperature r is the resistance of the probe. A, B, and C are the constants 86.979, .0226819, and 17.9 E-9 which were derived from a 2nd degree polynomial fitting the resistance curve between −5 and +5 degrees Celsius. |
| integrate | integrate performs a simple integration process by applying both the new and previous temperatures in the formula, new = old − (old − new)/8. This process is skipped in test mode, immediately after reset or after 4½ min. delays. |
| hitest | hitest first checks to see whether the temperature is below 40 degrees F. If it is, it turns on the stirrer motor. The high setpoint is then loaded. |
| hiO | hiO checks the current temperature against the high setpoint. If it is less than the setpoint program flow continues at lotest. Otherwise the current temperature is compared to 150 degrees Fahrenheit. If the temperature is greater than 150, we restart by sitting in a loop and not allowing the watch dog timer to be pulsed. The program continues by going to MAIN. |

-continued

| | |
|---|---|
| lotest | lotest loads the 1st low or low setpoints depending on whether we have previously passed below the 1st low setpoint. |
| loO | loO compares the low setpoint against the current temperature. If the current temperature is above the low setpoint then the program continues at with2. If the current temperature is less than the low [test] setpoint then the relay is turned or left on. The program continues by going to MAIN if in test mode. |
| wait | The program waits for 4.5 minutes to prevent the compressor for immediately turning back on, then continues at MAIN. |
| with2 | The current temperature was above the [test] setpoint, so the compressor relay is left in its current state. Program flow continues at MAIN. |
| pbody | pbody acts in two ways. When first called it synchronizes the program with the temperature period. When called again it returns the actual values of the high and low times. |

The single chip microcomputer 48 is a General Instrument PIC 1654. Some notable characteristics of the microcomputer are:

A. 512 program steps
B. 32 bytes of RAM
C. All instructions execute in 2 or 4 microseconds
D. All subroutines must begin in the lower half of memory.
E. It has an eight bit clock counter.
F. When master clear is pulled low and then released high, the program counter is set to the last program location (511).
G. The architecture includes a two level stack.

The program consists of 1 main program routine, 6 subroutines, and 7 floating point math subroutines.

In the accompanying source code (Exhibit A), the main program with its 5 subroutines, the begin routine, and the floating point subroutines each have separate listings. Each listing has a separate set of line numbers starting with 1.

The accompanying source code (Exhibit A) is sequenced in the same order as this description.

1. Lines 25 through 61 contain the register definitions.
   Lines 69 through 76 contain the address definitions of the floating point subroutines so that they can be called by the main routine and 5 subroutines of the 1st listing.
   Lines 84 through 171 are definitions of constants used within the program.
2. Line 186 is the entry point of a routine to measure the high and low periods of the temperature waveform. Placing the entry point here allows the body of the code (in the upper half of memory) to be called as a subroutine.
3. Line 204 is the only entry point for subroutine FIXB. Lines 204 through 219 repairs the mantissa for floating point register A with regard to the counting scheme used by subroutine period. Period counts within a 16 bit pseudo-register, but the upper 8 bits has the value of 128 not 256 as with a normal 16 bit number. FIXB divides the upper 8 bits by 2, then adds 128 to the lower 8 bits if the top 8 bits was not evenly divisible by 2.
4. Line 228 is the only entry point to subroutine movbw. Lines 228 through 239 move the contents of floating point register B to the floating point register pointed to by W at the onset of the CALL subroutine.
5. Line 248 is the only entry point to subroutine movwb. Lines 248 through 259 moves a floating point number pointed to by W at the onset of the CALL subroutine to floating point register B.
6. Line 267 is the only entry point to subroutine wdt. Lines 267 through 281 prevent the constant re-initialization, of the microcomputer by the watch-dog hardware during normal operation. By toggling the state of the wdog line capacitor CE3 is kept discharged preventing IC2 from self oscillating and resetting the PIC 1654.
   Lines 270 through 274 change the state of the wdog line from high to low.
   Lines 276 through 280 change the state of the wdog line from low to high.
7. Line 291 (BEGIN) is the entry point of the main program.
   Lines 291 through 295 initializes the flags so that the program remembers that this is the first operation and that no integration of temperature should occur.
   Lines 303 through 326 turn off the compressor relay and delay for 4½ minutes. If the test pin is held low the 4½ minute delay is skipped.
   Lines 334 through 339 initialize the temperature measurement loop.
   Lines 341 through 359 get the counts for the high and low portions of the temperature waveform for 1 time through the loop.
   Lines 361 through 373 calculate the sensor resistance from the high and low periods.
   Lines 375 through 382 adds the calculated resistance to the sum of all resistances for 64 loops.
   Lines 384 through 385 check to see if we have done all 64 loops.
   Lines 393 and 394 divide the sum of all loops by 64 to get the average resistance.
   Lines 407 through 462 convert the average resistance into the temperature in degrees Fahrenheit using the formula $T=A+Br=Cr\hat{}2$. T is the temperature and r is the resistance of the sensor. A, B, and C are the constants 86.979, 0.0226819, and 17.9 E−9, which were derived for a 2nd degree polynomial fitting the resistance curve between −5 and +5 degrees Celsius.
   Lines 464 through 495 add a correction factor to the calculated temperature. A digital offset is read from I/O port RB and converted to the correction factor by multiplying by 0.055906, then subtracting 3.55.
   Lines 506 through 528 do simple intergration to smooth out the data by applying the formula:

$$T=T(old)-[T(old)-T(new)]/8$$

The data is not integrated for the first measurement period after reset and after 4½ minute delays.
   Lines 537 through 662 comprise the setpoint tests.
   Lines 537 through 552 compare the temperature to 40 degrees F. If above 40 degrees F. the stirrer motor is turned off. If at or below 40 degrees F. the stirrer motor is turned on.
   Lines 554 through 595 compare the temperature to the high setpoint, 31.845 degrees F. If above the high setpoint, the temperature is compared to 150 degrees F. If above 150 degrees F. the program loops to itself at line 581 without toggling the watch dog timer. This restarts the microcomputer.

If the sensor wires get severely pinched during installation or operation and the sensor wires short, then the temperature waveform will compute to a temperature above 150 degrees F. and the compressor will remain off. If below 150 degrees F. the compressor relay is turned on. Program flow continues at line 364 (MAIN).

Lines 597 through 662 compare the temperature to the low setpoint. If the first-time flag is set, indicating that the control has not previously cycled through the low setpoint temperature, then the low setpoint is set at 27.000 degrees F. otherwise it is set at 29.500 degrees F. If the temperature is above the low setpoint (between setpoints) no action is taken and program flow continues at line 364 (MAIN). If the temperature is below the low setpoint then the compressor relay is turned off and the first-time flag is cleared to show that we have indeed cycled. Program flow then continues at line 364 (MAIN).

8. Lines 670 (pbody) through 712 times the high and low periods of the temperature waveform. it is used twice successively, once to synchronize with the waveform and once to actually measure the periods. If the sensor cord has been cut during installation or operation and the sensor appears as an open or very large resistance the 16 bit pseudo counter will overflow in lines 678–681 and the program loops to itself at line 681 without toggling the watchdog timer. This restarts the microcomputer.
9. Line 721 is the restart vector which contains the first instruction executed after a restart.
10. Lines 35 (BEGIN) through 39 zero all of the registers.

Lines 1 through 278 perform the floating point mathematical operations of addition, subtraction, multiplication, and division. The mantissa is a 16 bit long 2's complement representation of a number between −1/32,768 and 1/32,768. The exponent is an 8 bit two's complement representation of a number between −128 and 128. This provides a working range of numbers from positive or negative $2.9\times10^{-39}$ to positive or negative $3.4\times10^{38}$ with an accuracy exceeding 4 significant decimal digits.

11. Lines 38 (FSUB) through 91 performs floating point subtraction and addition. If the routine is entered at line 3, the number in floating point register A is 2's complemented then added to the number in floating point register B, to perform subtraction. If the routine is entered at line 4, no negation takes place and the numbers are merely added.
12. Lines 114 (FMPY) through 156 perform floating point multiplication on registers A and B with the product going to B.
13. Lines 159 (FDIV) through 211 perform floating point division with the result of B/A going to B.
14. Lines 219 (NEGA) through 224 negate floating point register A with the result remaining in A.
15. Lines 234 (NORM) through 251 perform normalization on floating point register B. Normalization shifts a floating point number left until the most significant bit is a 1 to maximize the mathematical precision. The sign and magnitude of the number stay the same. Only the representation changes.
16. Lines 259 (FSWAP) through 277 exchange the contents of floating point registers A and B.

While the preferred embodiments of this invention have been described above in detail, it is to be understood that variations and modifications can be made therein without departing from the spirit and scope of the present invention.

```
 1.                 TITLE "Coke Ice Detector 13  31.845 27.000 29.500   6 Mar 1987"
 2.
 3.            ;Notice for software
 4.
 5.            ;                    Project Ice Bank Control
 6.
 7.            ;Authors:    Doug Deeds, Jonathan Kirschner, Bill Steabridge,
 8.            ;            Frank Steabridge
 9.
10.            ;                    Date of publication: 2 March 1987
11.            ;                    Copyright, 1987
12.            ;                    An unpublished work of the Coca-Cola Company
13.            ;                    All Rights Reserved
14.
15.
16.
17.  0260                ORG    260
18.                      FINIT
19.
20.            +         LIST   P=1654,E,H
21.            +         NLIST  T,S,M
22.
23.             gisters
24.
25.  0000      +INDEX    EQU    0
26.  0001      +RTCC     EQU    1
27.  0002      +PC       EQU    2
28.  0003      +ASR      EQU    3
29.  0004      +FSR      EQU    4
30.  0005      +RA       EQU    5
31.  0006      +RB       EQU    6
32.
```

```
33.                 ;sters
34.
35.  0007           +ACLF   EQU   7
36.  0011           +EXPA   EQU   11
37.  0012           +ACCB   EQU   12
38.  0014           +EXPB   EQU   14
39.  0015           +TEMP   EQU   15
40.  0016           +ACCC   EQU   16
41.  0020           +EXPC   EQU   20
42.  0021           +ACCD   EQU   21
43.  0024           +EXPD   EQU   24
44.  0025           +SIGN   EQU   25
45.
46.                 ;.......................................................
47.                 ;
48.                 ; RAM Usage
49.                 ;
50.                 ;.......................................................
51.
52.  0026           loopsu  EQU   26
*** INFORMATIVE-LABEL TOO LONG, TRUNCATED
53.  0031           ACCF    EQU   31                ; .. Floating point register F
54.  0033           EXPF    EQU   33
55.  0034           flag    EQU   34                ; .. Flags
56.  0035           loop    EQU   35                ; .. General purpose loop counter
57.  0036           loop2   EQU   36
58.  0037           loop3   EQU   37
59.
60.  0035           ACCG    EQU   35
61.  0037           EXPG    EQU   37
62.
63.                 ;.......................................................
64.                 ;
65.                 ; Floating Point Routine Addresses
66.                 ;
67.                 ;.......................................................
68.
69.  0003           FSUB    EQU   0003
70.  0004           FADD    EQU   0004
71.  0065           FMPY    EQU   0065
72.  0104           NEGB    EQU   0104
73.  0132           FDIV    EQU   0132
74.  0211           NEGA    EQU   0211
75.  0217           NORM    EQU   0217
76.  0235           FSWAP   EQU   0235
77.
78.                 ;.......................................................
79.                 ;
80.                 ; Miscellaneous Constants
81.                 ;
82.                 ;.......................................................
83.
84.                 ;Setph1     EQU         7EH     ; .. 31.520 deg.
85.                 ;Setph2     EQU         014H+1  ; .. to test for >=
86.                 ;Setph3  EQU        05H
87.
88.                 ;Setph1     EQU         7EH     ; .. 31.620 deg.
89.                 ;Setph2     EQU         071H+1  ; .. to test for >=
90                  ;Setph3  EQU        05H
91.
92.                 ;Setph1     EQU         7EH     ; .. 31.720 deg.
93.                 ;Setph2     EQU         0E1H+1  ; .. to test for >=
94                  ;Setph3  EQU        05H
95.
96.  0177           Setph1  EQU   7FH               ; .. 31.845 deg.
97.  0141           Setph2  EQU   60H+1             ; .. to test for >=
98.  0005           Setph3  EQU   05H
99.
100.                ;Setph1     EQU         7FH     ; .. 31.920 deg.
```

EXHIBIT A

```
101.            ;Setph2     EQU     0AEH+1  ; .. to test for >=
102.            ;Setph3 EQU     05H
103.
104.            ;Setph1     EQU     7FH     ; .. 31.945 deg.
105.            ;Setph2     EQU     0C9H+1  ; .. to test for >=
106.            ;Setph3 EQU     05H
107.
108.            ;Setph1     EQU     40H     ; .. 32.000 deg.
109.            ;Setph2     EQU     00H+1   ; .. to test for >=
110.            ;Setph3 EQU     06H
111.
112.            ;Setpl1     EQU     7BH     ; .. 30.988 deg.
113.            ;Setpl2     EQU     0F3H    ; .. to test for <=
114.            ;Setpl3     EQU     05H
115.
116.            ;Setpl1     EQU     7BH     ; .. 30.888 deg.
117.            ;Setpl2     EQU     0B3H    ; .. to test for <=
118.            ;Setpl3     EQU     05H
119.
120.            ;Setpl1     EQU     7BH     ; .. 30.788 deg.
121.            ;Setpl2     EQU     76H     ; .. to test for <=
122.            ;Setpl3     EQU     05H
123.
124.            ;Setpl1     EQU     7AH     ; .. 30.500 deg.
125.            ;Setpl2     EQU     00H     ; .. to test for <=
126.            ;Setpl3     EQU     05H
127.
128.  0166      Setpl1  EQU     76H             ; .. 29.500 deg.
129.  0000      Setpl2  EQU     00H             ; .. to test for <=
130.  0005      Setpl3  EQU     05H
131.
132.            ;first1     EQU     70H     ; .. 28.000 deg.
133.            ;first2     EQU     00H     ; .. to test for <=
134.            ;first3     EQU     05H
135.
136.  0154      first1  EQU     6CH             ; .. 27.000 deg.
137.  0000      first2  EQU     00H             ; .. to test for <=
138.  0005      first3  EQU     05H
139.
140.  0122      hi150   EQU     52H             ; .. 150 deg. ( 82.33 really)
141.  0124      lo150   EQU     54H
142.  0007      exp150  EQU     7H
143.
144.  0160      hi60    EQU     70H             ; .. 60 deg. ( 56.388)
145.  0306      lo60    EQU     0C6H
146.  0006      exp60   EQU     6H
147.
148.  0120      hi40    EQU     50H             ; .. 40 deg. approximately
149.  0000      lo40    EQU     00H
150.  0006      exp40   EQU     6H
151.
152.  0106      hi35    EQU     46H             ; .. 35 deg. approximately
153.  0000      lo35    EQU     00H
154.  0006      exp35   EQU     6H
155.
156.  0013      wofrof  EQU     0BH             ; .. WDT off, relay off
157.  0012      wofron  EQU     0AH             ; .. WDT off, relay on
158.  0017      wonrof  EQU     0FH             ; .. WDT on, relay off
159.  0016      wonron  EQU     0EH             ; .. WDT on, relay on
160.
161.  0000      first   EQU     0
162.  0002      noint   EQU     2
163.  0003      wdog    EQU     3
164.  0004      nowait  EQU     4
165.  0005      below   EQU     5
166.  0006      above   EQU     6
167.  0007      relay   EQU     7
168.
169.  0000      relout  EQU     0
170.  0002      wdtout  EQU     2
```

```
171.  0003        tempin  EQU   3
172.
173.              ;.............................................................
174.              ;
175.              ; register usage
176.              ;
177.              ;   flag,0          first time
178.              ;   flag,1          overflow
179.              ;   flag,2          no integration
180.              ;   flag,3          WDT state
181.              ;   flag,4          no wait
182.              ;   flag,5          last sample was below low setpoint
183.              ;   flag,6          last sample was above high setpoint
184.              ;   flag,7          relay on
185.
186.
187.              ;.............................................................
188.              ;
189.              ; period                .. measures the low and high times of
190.              ;                       .. the input on bit 0 of RA
191.              ;                       .. OUTPUT: lh in ACCB
192.              ;                       ..         hl in ACCA
193.              ;
194.              ;.............................................................
195.
196.  0260  0BD9  period  GOTO   lh1
197.
198.              ;.............................................................
199.              ;
200.              ; FIXB
201.              ;
202.              ;.............................................................
203.
204.  0261  0C0F  FIXB    MOVLW  0FH
205.  0262  002C          MOVWF  EXPB
206.  0263  0403          BCF    ASR,0              ; .. Clear carry
207.  0264  032A          RRF    ACCB               ; .. Rotate into carry
208.  0265  0703          BTFSS  ASR,0              ; .. Skip on carry
209.  0266  0A8F          GOTO   NORM
210.
211.  0267  06EB          BTFSC  0BH,7              ; .. Skip on ACCB+1 < 128
212.  0270  0A8B          GOTO   fix1
213.
214.  0271  05EB          BSF    0BH,7              ; .. Set MSB
215.  0272  0A8F          GOTO   NORM
216.
217.  0273  02AA  fix1    INCF   ACCB               ; .. Add another 256
218.  0274  04EB          BCF    0BH,7              ; .. Same as adding 128
219.  0275  0A8F          GOTO   NORM
220.
221.              ;.............................................................
222.              ;
223.              ; movbw                           .. Use W as an index to move fB
224.              ;                              .. to a floating point #
225.              ;
226.              ;.............................................................
227.
228.  0276  0024  movbw   MOVWF  FSR
229.  0277  020A          MOVF   ACCB,W
230.  0300  0020          MOVWF  INDEX
231.
232.  0301  02A4          INCF   FSR
233.  0302  020B          MOVF   ACCB+1,W
234.  0303  0020          MOVWF  INDEX
235.
236.  0304  02A4          INCF   FSR
237.  0305  020C          MOVF   EXPB,W
238.  0306  0020          MOVWF  INDEX
239.  0307  0800          RETLW  0
240.
```

```
241.            ;.............................................................
242.            ;
243.            ; movwb                                  .. Use W as an index to save a
244.            ;                                  .. floating point # to fB
245.            ;
246.            ;.............................................................
247.
248.  0310  0024  movwb   MOVWF  FSR
249.  0311  0200          MOVF   INDEX,W
250.  0312  002A          MOVWF  ACCB
251.
252.  0313  02A4          INCF   FSR
253.  0314  0200          MOVF   INDEX,W
254.  0315  002B          MOVWF  ACCB+1
255.
256.  0316  02A4          INCF   FSR
257.  0317  0200          MOVF   INDEX,W
258.  0320  002C          MOVWF  EXPB
259.  0321  0800          RETLW  0
260.
261.            ;.............................................................
262.            ;
263.            ;    W(atch) D(og) T(imer)
264.            ;
265.            ;.............................................................
266.
267.  0322  077C  wdt     BTFSS  flag,wdog          ; .. See what the WDT's current state is
268.  0323  0AD9          GOTO   wdt1
269.
270.  0324  047C          BCF    flag,wdog          ; .. It was on so turn it off
271.  0325  0C0A          MOVLW  wofron
272.  0326  07FC          BTFSS  flag,relay
273.  0327  0C0B          MOVLW  wofrof
274.  0330  0ADD          GOTO   wdt2
275.
276.  0331  057C  wdt1    BSF    flag,wdog          ; .. It was off so turn it on
277.  0332  0C0E          MOVLW  wonron
278.  0333  07FC          BTFSS  flag,relay
279.  0334  0C0F          MOVLW  wonrof
280.  0335  0025  wdt2    MOVWF  RA
281.  0336  0869          RETLW  69H
282.
283.            ;.............................................................
284.            ;
285.            ; BEGIN                                  .. Do everything
286.            ;
287.            ;.............................................................
288.
289.
290.
291.  0337  0C05  BEGIN   MOVLW  00000101B          ; .. Set no integrate and first time flags
292.  0340  003C          MOVWF  flag                ; .. Clear all others
293.
294.  0341  0C0F          MOVLW  wonrof
295.  0342  0025          MOVWF  RA
296.
297.            ;.............................................................
298.            ;
299.            ;    4.5 minute delay
300.            ;
301.            ;.............................................................
302.
303.  0343  055C  wait    BSF    flag,noint         ; .. No integration on return
304.
305.  0344  0C77          MOVLW  077H
306.  0345  003D          MOVWF  loop
307.
308.  0346  007E  wait1   CLRF   loop2
309.  0347  04FC          BCF    flag,relay         ; .. Make damn sure that the relay is off !!!
310.
311.  0350  007F  wait2   CLRF   loop3
```

```
312.  0351  09D2          CALL   wdt
313.
314.  0352  0C07  wait3   MOVLW  ACCA          ; .. Kill lots of time
315.  0353  09BE          CALL   movbw
316.  0354  02FF          DECFSZ loop3
317.  0355  0AEA          GOTO   wait3
318.
319.  0356  0725          BTFSS  RA,1           ; .. Test mode?
320.  0357  0AF4          GOTO   MAIN           ; .. If in test get out of loop
321.
322.  0360  02FE          DECFSZ loop2
323.  0361  0AE8          GOTO   wait2
324.
325.  0362  02FD          DECFSZ loop
326.  0363  0AE6          GOTO   wait1
327.
328.              ;.....................................................
329.              ;
330.              ; MAIN
331.              ;
332.              ;.....................................................
333.
334.  0364  0076  MAIN    CLRF   loopsum        ; .. Clear loop sum
335.  0365  0077          CLRF   loopsum+1
336.  0366  007B          CLRF   loopsum+2
337.
338.  0367  0C40          MOVLW  40H
339.  0370  003D          MOVWF  loop
340.
341.  0371  09D2  m1      CALL   wdt
342.  0372  09B0          CALL   period         ; .. Get in sync
343.  0373  09D2          CALL   wdt
344.  0374  09B0          CALL   period         ; .. Get some actual values
345.
346.  0375  09B1          CALL   FIXB
347.  0376  099D          CALL   FSWAP
348.  0377  09B1          CALL   FIXB
349.
350.  0400  0C19          MOVLW  ACCF           ; .. Save low
351.  0401  09BE          CALL   movbw
352.
353.  0402  099D          CALL   FSWAP
354.  0403  0903          CALL   FSUB           ; .. high - low ; result in fB
355.  0404  098F          CALL   NORM
356.  0405  099D          CALL   FSWAP          ; .. move result to fA
357.
358.  0406  0C19          MOVLW  ACCF           ; .. Get back low
359.  0407  09CB          CALL   movwb
360.
361.  0410  099D          CALL   FSWAP
362.  0411  095A          CALL   FDIV           ; .. ( high-low)/low
363.  0412  098F          CALL   NORM
364.
365.  0413  0C5D          MOVLW  5DH            ; .. 1500
366.  0414  0027          MOVWF  ACCA
*** INFORMATIVE-INCONSISTENT USE OF SYMBOL
367.  0415  0CC0          MOVLW  0C0H
368.  0416  0028          MOVWF  ACCA+1
*** INFORMATIVE-INCONSISTENT USE OF SYMBOL
369.  0417  0C0B          MOVLW  0BH            ; .. 1500
370.              ;   MOVLW        0AH
371.  0420  0029          MOVWF  EXPA
372.  0421  0935          CALL   FMPY           ; .. 1500 * ( high-low)/low
373.  0422  098F          CALL   NORM
374.
375.  0423  099D          CALL   FSWAP
376.  0424  0C16          MOVLW  loopsum
*** INFORMATIVE-INCONSISTENT USE OF SYMBOL
377.  0425  09CB          CALL   movwb          ; .. Get the loop sum
378.  0426  0904          CALL   FADD
```

```
379.  0427  098F        CALL   NORM
380.
381.  0430  0C16        MOVLW  loopsum
*** INFORMATIVE-INCONSISTENT USE OF SYMBOL
382.  0431  09BE        CALL   movbw            ; .. Replace loop sum
383.
384.  0432  02FD        DECFSZ loop             ; .. See if we've done this however many #'s
385.  0433  0AF9        GOTO   ai
386.
387.            ;.............................................................
388.            ;
389.            ; fixexp                      .. Fix the exponent
390.            ;
391.            ;.............................................................
392.
393.  0434  0C06        MOVLW  06H              ; .. /2^6
394.  0435  00AC        SUBWF  EXPB
395.
396.
397.            ;                             .. loop sum is still in fB
398.
399.            ;.............................................................
400.            ;
401.            ;   fahr                      .. Calculate the temperature
402.            ;                             .. at a given resistance
403.            ;                             .. Input: R in ACCB
404.            ;
405.            ;.............................................................
406.
407.  0436  0C19  fahr   MOVLW  ACCF
408.  0437  09BE        CALL   movbw            ; .. Save resistance
409.
410.  0440  0C4A        MOVLW  4AH              ; .. B = .002268193289 or 2.2680759E-3
411.  0441  0027        MOVWF  ACCA
*** INFORMATIVE-INCONSISTENT USE OF SYMBOL
412.  0442  0C52        MOVLW  52H
413.  0443  0028        MOVWF  ACCA+1
*** INFORMATIVE-INCONSISTENT USE OF SYMBOL
414.  0444  0CF8        MOVLW  0FBH
415.  0445  0029        MOVWF  EXPA
416.
417.  0446  0935        CALL   FMPY             ; ..( MAY NOT WORK WITH NEG TEMPS)
418.  0447  098F        CALL   NORM             ; .. BX
419.
420.  0450  0C56        MOVLW  56H              ; .. A= 96.9790867393 or 96.976562
421.  0451  0027        MOVWF  ACCA
*** INFORMATIVE-INCONSISTENT USE OF SYMBOL
422.  0452  0CFA        MOVLW  0FAH
423.  0453  0028        MOVWF  ACCA+1
*** INFORMATIVE-INCONSISTENT USE OF SYMBOL
424.  0454  0C07        MOVLW  07H
425.  0455  0029        MOVWF  EXPA
426.
427.  0456  099D        CALL   FSWAP
428.  0457  0903        CALL   FSUB
429.  0460  098F        CALL   NORM             ; .. A-BX
430.
431.  0461  0C1D        MOVLW  ACCB
432.  0462  09BE        CALL   movbw            ; .. Save A+BX
433.
434.  0463  0C19        MOVLW  ACCF
435.  0464  09CB        CALL   movwb            ; .. Get back resistance
436.
437.  0465  099D        CALL   FSWAP
438.  0466  0C19        MOVLW  ACCF
439.  0467  09CB        CALL   movwb            ; .. Get it again
440.
441.  0470  0935        CALL   FMPY
442.  0471  098F        CALL   NORM             ; .. X^2
443.
```

```
0472  0C4C        MOVLW  4CH          ; .. C=.00000001790777 or 17.907041E-9
0473  0027        MOVWF  ACCA
*** INFORMATIVE-INCONSISTENT USE OF SYMBOL
0474  0CE9        MOVLW  0E9H
0475  0029        MOVWF  ACCA+1
*** INFORMATIVE-INCONSISTENT USE OF SYMBOL
0476  0CE7        MOVLW  0E7H
0477  0029        MOVWF  EXPA

0500  0935        CALL   FMPY
0501  098F        CALL   NORM         ; .. CX^2
0502  099D        CALL   FSWAP

0503  0C1D        MOVLW  ACC6
0504  09C8        CALL   movwb        ; .. get back A+BX

0505  0904        CALL   FADD
0506  098F        CALL   NORM         ; .. A+BX+CX^2

0507  0C1D        MOVLW  ACC6
0510  09BE        CALL   movbw        ; .. Save A+BX+CX^2

0511  0206        MOVF   RB,W         ; .. Get offset data
0512  0E7F        ANDLW  7FH          ; .. Mask off stirrer motor bit
0513  0027        MOVWF  ACCA
*** INFORMATIVE-INCONSISTENT USE OF SYMBOL
0514  0068        CLRF   ACCA+1
*** INFORMATIVE-INCONSISTENT USE OF SYMBOL
0515  0C07        MOVLW  07H          ; .. Make an exponent for a 7 bit integer
0516  0029        MOVWF  EXPA

0517  0C72        MOVLW  72H          ; .. .055906
0520  002A        MOVWF  ACCB
0521  0C7E        MOVLW  7EH
0522  002B        MOVWF  ACCB+1
0523  0CFC        MOVLW  0FCH
0524  002C        MOVWF  EXPB

0525  0935        CALL   FMPY         ; .. Offset * .055906
0526  098F        CALL   NORM

0527  0C71        MOVLW  71H          ; .. 3.55
0530  0027        MOVWF  ACCA
*** INFORMATIVE-INCONSISTENT USE OF SYMBOL
0531  0C99        MOVLW  99H
0532  002B        MOVWF  ACCA+1
*** INFORMATIVE-INCONSISTENT USE OF SYMBOL
0533  0C02        MOVLW  02H
0534  0029        MOVWF  EXPA

0535  0903        CALL   FSUB         ; .. Offset ( in degrees) - offset constant
0536  098F        CALL   NORM
0537  099D        CALL   FSWAP

0540  0C1D        MOVLW  ACC6         ; .. Get back A+BX+CX^2
0541  09C8        CALL   movwb
0542  0903        CALL   FSUB         ; .. Calculate actual temperature
0543  098F        CALL   NORM

            ;.............................................................
            ;
            ; integrate                 .. Do simple integration to smooth
            ;                           .. the timings
            ;                           .. averaged data is TEMPERATURE
            ;
            ;.............................................................

0544  075C  intgr   BTFSS  flag,noint   ; .. Skip if no integration flag is set
0545  0B68          GOTO   intgr1
```

```
0546  045C          BCF    flag,noint        ; .. Go to integrate mode
0547  0B74          GOTO   intgr2            ; .. but skip integration this time

0550  099D  intgr1  CALL   FSWAP
0551  0C0E          MOVLW  ACCC
0552  09C8          CALL   movwb             ; .. Get last reading sum
0553  0903          CALL   FSUB              ; .. Old - new
0554  098F          CALL   NORM

0555  0C03          MOVLW  3
0556  00AC          SUBWF  EXPB              ; .. /8

0557  099D          CALL   FSWAP
0560  0C0E          MOVLW  ACCC
0561  09C8          CALL   movwb
0562  0903          CALL   FSUB              ; .. Old - ( old - new)/8
0563  098F          CALL   NORM

0564  0C0E  intgr2  MOVLW  ACCC
0565  09BE          CALL   movbw             ; .. Save the value as the old value


            ;.....................................................
            ;
            ; Setpoint tests
            ;-----------------------------------------------------
            ;.....................................................

0566  0C50  hitest  MOVLW  hi40              ; .. Load 40 degree F. stirrer on-point
0567  0027          MOVWF  ACCA
*** INFORMATIVE-INCONSISTENT USE OF SYMBOL
0570  0C00          MOVLW  lo40
0571  002B          MOVWF  ACCA+1
*** INFORMATIVE-INCONSISTENT USE OF SYMBOL
0572  0C06          MOVLW  exp40
0573  0029          MOVWF  EXPA

0574  0C0E          MOVLW  ACCC
0575  09C8          CALL   movwb
0576  099D          CALL   FSWAP
0577  0903          CALL   FSUB              ; .. 40 - loop

0600  0C7F          MOVLW  07FH              ; .. Turn on stirrer motor if < 60,  ( Stirrer circuitry is active low)
0601  06EA          BTFSC  ACCB,7
0602  0CFF          MOVLW  0FFH              ; .. Turn off stirrer motor if > 60  ( But will be normally closed)
0603  0026          MOVWF  RB

0604  0C7F          MOVLW  Setph1            ; .. Load fA with high setpoint
0605  0027          MOVWF  ACCA
*** INFORMATIVE-INCONSISTENT USE OF SYMBOL
0606  0C61          MOVLW  Setph2
0607  002B          MOVWF  ACCA+1
*** INFORMATIVE-INCONSISTENT USE OF SYMBOL
0610  0C05          MOVLW  Setph3
0611  0029          MOVWF  EXPA

0612  0C0E  hi0     MOVLW  ACCC
0613  09C8          CALL   movwb             ; .. Get loop value

0614  099D          CALL   FSWAP
0615  0903          CALL   FSUB              ; .. Setpoint - loop value
0616  07EA          BTFSS  ACCB,7
0617  0BA7          GOTO   lotest

0620  0C52          MOVLW  hi150             ; .. Load 150 degree F. setpoint
0621  0027          MOVWF  ACCA
*** INFORMATIVE-INCONSISTENT USE OF SYMBOL
0622  0C54          MOVLW  lo150
0623  002B          MOVWF  ACCA+1
*** INFORMATIVE-INCONSISTENT USE OF SYMBOL
```

```
573.  0624  0C07          MOVLW  exp150
574.  0625  0029          MOVWF  EXPA
575.
576.  0626  0C0E          MOVLW  ACCC
577.  0627  09C8          CALL   movwb
578.  0630  099D          CALL   FSWAP
579.  0631  0903          CALL   FSUB              ; .. 150 - loop
580.  0632  06EA          BTFSC  ACCB,7
581.  0633  0B9B  hi1     GOTO   hi1               ; .. restart if over 150 degrees
582.
583.  0634  07DC          BTFSS  flag,above        ; .. If we were high before then turn on
584.  0635  0BA5          GOTO   hi2
585.
586.  0636  04DC          BCF    flag,above
587.  0637  05FC          BSF    flag,relay        ; .. Set relay state flag
588.  0640  0C0E          MOVLW  wonron            ; .. Turn on relay
589.  0641  077C          BTFSS  flag,wdog
590.  0642  0C0A          MOVLW  wofron
591.  0643  0025          MOVWF  RA
592.  0644  0AF4          GOTO   MAIN
593.
594.  0645  05DC  hi2     BSF    flag,above
595.  0646  0AF4          GOTO   MAIN
596.
597.  0647  0C76  lotest  MOVLW  Setpl1            ; .. Load low setpoint
598.  0650  0027          MOVWF  ACCA
*** INFORMATIVE-INCONSISTENT USE OF SYMBOL
599.  0651  0C00          MOVLW  Setpl2
600.  0652  002B          MOVWF  ACCA+1
*** INFORMATIVE-INCONSISTENT USE OF SYMBOL
601.  0653  0C05          MOVLW  Setpl3
602.  0654  0029          MOVWF  EXPA
603.
604.  0655  071C          BTFSS  flag,first        ; .. See if this is the first time through the bottom setpoint
605.  0656  0BB5          GOTO   lo0               ; .. if not, then skip loading the first low setpoint
606.
607.  0657  0C6C          MOVLW  first1            ; .. Load first low setpoint
608.  0660  0027          MOVWF  ACCA
*** INFORMATIVE-INCONSISTENT USE OF SYMBOL
609.  0661  0C00          MOVLW  first2
610.  0662  002B          MOVWF  ACCA+1
*** INFORMATIVE-INCONSISTENT USE OF SYMBOL
611.  0663  0C05          MOVLW  first3
612.  0664  0029          MOVWF  EXPA
613.
614.  0665  0C0E  lo0     MOVLW  ACCC              ; .. Get loop value
615.  0666  09C8          CALL   movwb
616.  0667  099D          CALL   FSWAP
617.  0670  0903          CALL   FSUB              ; .. Low setpoint - loop value
618.
619.  0671  06EA          BTFSC  ACCB,7
620.  0672  0BCC          GOTO   with2             ; .. Sign set so within setpoints
621.
622.  0673  041C          BCF    flag,first        ; .. We're below the low setpoint so don't use 28.000 again
623.
624.  0674  06BC          BTFSC  flag,below        ; .. Were we below before?
625.  0675  0BC0          GOTO   lo1
626.
627.  0676  05BC          BSF    flag,below        ; .. Yes, so don't do anything
628.  0677  0AF4          GOTO   MAIN
629.
630.  0700  04BC  lo1     BCF    flag,below
631.  0701  0605          BTFSC  RA,relout         ; .. If relay on, then go off
632.  0702  059C          BSF    flag,nowait       ; .. Don't delay
633.
634.  0703  04FC          BCF    flag,relay        ; .. Clear relay state flag
635.  0704  0C0F          MOVLW  wonrof            ; .. Turn off relay
636.  0705  077C          BTFSS  flag,wdog
637.  0706  0C0B          MOVLW  wofrof
638.  0707  0025          MOVWF  RA
639.
```

```
0710  079C  delay   BTFSS  flag,nowait
0711  0AE3          GOTO   wait

0712  049C          BCF    flag,nowait
0713  0AF4          GOTO   MAIN

0714  04DC  with2   BCF    flag,above
0715  04BC          BCF    flag,below

0716  06FC          BTFSC  flag,relay        ; .. See what state we're in
0717  0BD4          GOTO   with3

0720  0C0F          MOVLW  wonrof            ; .. Relay off
0721  077C          BTFSS  flag,wdog         ; .. WDT?
0722  0C0B          MOVLW  wofrof
0723  0BD7          GOTO   with4

0724  0C0E  with3   MOVLW  wonron            ; .. Relay on
0725  077C          BTFSS  flag,wdog         ; WDT?
0726  0C0A          MOVLW  wofron

0727  0025  with4   MOVWF  RA
0730  0AF4          GOTO   MAIN

                    ;.....................................................
                    ;
                    ; phody                          .. the body of period
                    ;
                    ;.....................................................

0731  0665  lh1     BTFSC  RA,tempin         ; .. if clear continue counting
0732  0BE1          GOTO   lhend

0733  07E1          BTFSS  RTCC,7            ; .. Skip if RTCC > 127
0734  0BD9          GOTO   lh1

0735  04E1          BCF    RTCC,7            ; .. Start the counting again

0736  03ED          INCFSZ TEMP              ; .. Skip if TEMP has overflowed
0737  0BD9          GOTO   lh1

0740  0BE0  lh2     GOTO   lh2               ; .. Data is worthless so restart

0741  0201  lhend   MOVF   RTCC,W
0742  0061          CLRF   RTCC              ; .. Clear RTCC
0743  002B          MOVWF  ACCA+1
*** INFORMATIVE-INCONSISTENT USE OF SYMBOL
0744  020D          MOVF   TEMP,W
0745  0027          MOVWF  ACCA
*** INFORMATIVE-INCONSISTENT USE OF SYMBOL

0746  006D          CLRF   TEMP              ; .. Clear pseudo upper byte of RTC

0747  0765  hl1     BTFSS  RA,tempin         ; .. Go on if high_low transition
0750  0BEF          GOTO   HLEND

0751  07E1          BTFSS  RTCC,7            ; .. skip if RTCC > 127
0752  0BE7          GOTO   hl1

0753  04E1          BCF    RTCC,7            ; .. start the counting again
                    ;                       .. from 128 not 0
0754  03ED          INCFSZ TEMP              ; .. skip if TEMP has overflowed
0755  0BE7          GOTO   hl1

0756  0BEE  hl2     GOTO   hl2               ; .. Data is worthless so restart

0757  0201  HLEND   MOVF   RTCC,W            ; .. get lower 8 bits of lh
0760  0061          CLRF   RTCC              ; .. Clear real time counter
0761  002B          MOVWF  ACCB+1            ; .. save thes

0762  020D          MOVF   TEMP,W            ; .. get upper 8 bits of hl
```

```
0763  006D          CLRF   TEMP          ; .. Clear pseudo upper byte of RTC
0764  002A          MOVWF  ACCB          ; .. save them

0765  0800  p2      RETLW  0

            ;.....................................................
            ;
            ; ending            .. master clear restart vector
            ;
            ;.....................................................

0777        ending  ORG    777           ; .. Last instruction in ROM
0777  0ADF          GOTO   BEGIN

                    END
```

```
                        TITLE   "Begin"
                        FINIT                          :DEFINITIONS

            +           LIST    P=1654,E,H
            +           NLIST   T,S,M

             gisters
0000        +INDEX      EQU     0
0001        +RTCC       EQU     1
0002        +PC         EQU     2
0003        +ASR        EQU     3
0004        +FSR        EQU     4
0005        +RA         EQU     5
0006        +RB         EQU     6

             gisters

0007        +ACCA       EQU     7
0011        +EXPA       EQU     11
0012        +ACCB       EQU     12
0014        +EXPB       EQU     14
0015        +TEMP       EQU     15
0016        +ACCC       EQU     16
0020        +EXPC       EQU     20
0021        +ACCD       EQU     21
0024        +EXPD       EQU     24
0025        +SIGN       EQU     25

             ; BEGIN
             ; ZEROES ALL REGISTERS AT MASTER CLEAR

0357                    ORG     357

0357  0C07  BEGIN       MOVLW   07
0360  0024              MOVWF   FSR
0361  0060  ZERAM       CLRF    INDEX
0362  03E4              INCFSZ  FSR
0363  0AF1              GOTO    ZERAM

                        END
```

```
                        TITLE  "Floating Point Math Package"

0000                    ORG    000

                        FINIT

                +       LIST   P=1654,E,H
                +       NLIST  T,S,M

                I/O Registers

0000            +INDEX  EQU    0
0001            +RTCC   EQU    1
0002            +PC     EQU    2
0003            +ASR    EQU    3
0004            +FSR    EQU    4
0005            +RA     EQU    5
0006            +RB     EQU    6

                int registers

0007            +ACCA   EQU    7
0011            +EXPA   EQU    11
0012            +ACCB   EQU    12
0014            +EXPB   EQU    14
0015            +TEMP   EQU    15
0016            +ACCC   EQU    16
0020            +EXPC   EQU    20
0021            +ACCD   EQU    21
0024            +EXPD   EQU    24
0025            +SIGN   EQU    25

0000  07EC  FA3         BTFSS  EXPB,7          ;SKIP ON EXPB NEGATIVE
0001  0A0C              GOTO   FA0

0002  0A10              GOTO   FA2

0003  0989  FSUB        CALL   NEGA            ; .. If you are subtracting negate fA

0004  0209  FADD        MOVF   EXPA,W          ; .. Scale mantissas
0005  018C              XORWF  EXPB,W          ;FIND GREATER EXPONENT
0006  0643              BTFSC  ASR,2           ; .. Skip on EXPA not equal to EXPB
0007  0A17              GOTO   PADD

0010  07E9              BTFSS  EXPA,7          ; .. Skip on EXPA negative
0011  0A00              GOTO   FA3

0012  07EC              BTFSS  EXPB,7          ; .. Skip on EXPB negative
0013  0A0F              GOTO   FA1

0014  0209  FA0         MOVF   EXPA,W          ;COMPARE EXPA WITH EXPB
0015  008C              SUBWF  EXPB,W
0016  0603              BTFSC  ASR,0           ;SKIP ON EXPA < EXPB
0017  099B  FA1         CALL   FSWAP           ;MAKE EXPA < EXPB
0020  0209  FA2         MOVF   EXPA,W
0021  00AC              SUBWF  EXPB            ;EXPB = COUNT F.  SHIFT RIGHT
0022  092B  SCLOOP      CALL   MASRI
0023  03EC              INCFSZ EXPB
0024  0A12              GOTO   SCLOOP

0025  0209              MOVF   EXPA,W
0026  002C              MOVWF  EXPB

0027  0207  PADD        MOVF   ACCA,W          ; .. Find sign of result
0030  010A              IORWF  ACCB,W          ;FOR OVERFLOW CHECK
0031  0035              MOVWF  SIGN
0032  0921              CALL   MADD
0033  07F5              BTFSS  SIGN,7          ;CHECK FOR OVERFLOW
0034  07EA              BTFSS  ACCB,7
0035  0B00              RETLW  0
```

```
0036 0403          BCF    ASR,0          ;CLEAR CARRY
0037 02AC          INCF   EXPB           ;OVERFLOW
0040 0A2B          GOTO   ASRHCK         ;SCALE TO RIGHT

0041 020B  MADD    MOVF   ACCA+1,W
0042 01EB          ADDWF  ACCB+1
0043 0603          BTFSC  ASR,0          ;ADD CARRY
0044 02AA          INCF   ACCB
0045 0207          MOVF   ACCA,W
0046 01EA          ADDWF  ACCB
0047 0800          RETLW  0

0050 0403  MASR1   BCF    ASR,0          ;CLEAR CARRY
0051 06EA          BTFSC  ACCB,7
0052 0503          BSF    ASR,0
0053 032A  ASRHCK  RRF    ACCB
0054 032B          RRF    ACCB+1
0055 0800          RETLW  0

           ;.....................................................
           ;
           ; MASL1                        .. 16 bit shift left
           ;
           ;.....................................................

0056 0403  MASL1   BCF    ASR,0          ; .. Clear carry
0057 036B          RLF    ACCB+1         ; .. Sift the 16 bits
0060 036A          RLF    ACCB
0061 04EA          BCF    ACCB,7         ; .. Clear the MSB
0062 0603          BTFSC  ASR,0          ; .. Skip if no carry
0063 05EA          BSF    ACCB,7         ; .. Sign had been negative so fix MSB
0064 0800          RETLW  0

           ;.....................................................
           ;
           ; FMPY                         .. Floating point multiply
           ;                          .. fA * fB --> fB
           ;
           ;.....................................................

0065 097D  FMPY    CALL   FSIGN
0066 094A          CALL   SETUP
0067 0331  MPLOOP  RRF    ACCD           ;ROTATE D R GHT
0070 0332          RRF    ACCD+1
0071 0603          BTFSC  ASR,0          ;NO SKIP ON ADD
0072 0921          CALL   MADD           ;ADD A TO B
0073 032A          RRF    ACCB           ;ROTATE B RIGHT
0074 032B          RRF    ACCB+1
0075 02EB          DECFSZ TEMP           ;LOOP TILL DONE
0076 0A37          GOTO   MPLOOP

0077 0209          MOVF   EXPA,W         ;ADD EXPONENTS
0100 01EC          ADDWF  EXPB
0101 02AC          INCF   EXPB
0102 07F5  FINUP   BTFSS  SIGN,7
0103 0A8F          GOTO   NORM

0104 00EB  NEGB    DECF   ACCB+1
0105 026B          COMF   ACCB+1
0106 0643          BTFSC  ASR,2          ;SKIP ON NOT ZERO
0107 00EA          DECF   ACCB
0110 026A          COMF   ACCB
0111 0A8F          GOTO   NORM

0112 0C10  SETUP   MOVLW  .16            ;16 PLACE SHIFT
0113 002D          MOVWF  TEMP
0114 020A          MOVF   ACCB,W         ;MOVE B TO D
```

```
141.  0115  0031          MOVWF  ACCD
142.  0116  020B          MOVF   ACCB+1,W
143.  0117  0032          MOVWF  ACCD+1
144.  0120  006A          CLRF   ACCB              ;CLEAR B
145.  0121  006B          CLRF   ACCB+1
146.  0122  0B00          RETLW  0
147.
148.
149.  0123  0207  COMPAR  MOVF   ACCA,W
150.  0124  0091          SUBWF  ACCD,W
151.  0125  0743          BTFSS  ASR,2
152.
153.  0126  0B00          RETLW  0
154.  0127  0208          MOVF   ACCA+1,W
155.  0130  0092          SUBWF  ACCD+1,W
156.  0131  0B00          RETLW  0
157.
158.
159.  0132  097D  FDIV    CALL   PSIGN
160.  0133  094A          CALL   SETUP
161.  0134  04E7          BCF    ACCA,7
162.  0135  04F1          BCF    ACCD,7
163.  0136  0372          RLF    ACCD+1
164.  0137  0371          RLF    ACCD
165.  0140  036B          RLF    ACCA+1
166.  0141  0367          RLF    ACCA
167.  0142  00ED          DECF   TEMP
168.  0143  0953          CALL   COMPAR
169.  0144  0703          BTFSS  ASR,0             ;SKIP ON CARRY
170.  0145  0A68          GOTO   D1
171.
172.  0146  02AC          INCF   EXPB
173.  0147  0A6F          GOTO   D2
174.
175.  0150  0372  D1      RLF    ACCD+1            ;ROTATE ACCD LEFT
176.  0151  0371          RLF    ACCD
177.  0152  0603          BTFSC  ASR,0             ;SKIP ON NO CARRY
178.  0153  0A6F          GOTO   D2
179.
180.  0154  0953          CALL   COMPAR
181.  0155  0703          BTFSS  ASR,0
182.  0156  0A76          GOTO   D3
183.
184.  0157  020B  D2      MOVF   ACCA+1,W          ;C-A -->C
185.  0160  00E2          SUBWF  ACCD+1
186.  0161  0703          BTFSS  ASR,0
187.  0162  00F1          DECF   ACCD
188.  0163  0207          MOVF   ACCA,W
189.  0164  00B1          SUBWF  ACCD
190.  0165  0503          BSF    ASR,0             ;SET CARRY
191.  0166  036B  D3      RLF    ACCB+1
192.  0167  036A          RLF    ACCB
193.  0170  02ED          DECFSZ TEMP
194.  0171  0A68          GOTO   D1
195.
196.  0172  0209          MOVF   EXPA,W
197.  0173  00AC          SUBWF  EXPB
198.  0174  0A42          GOTO   FINUP
199.  0175  0207  PSIGN   MOVF   ACCA,W            ;PREPARE SIGN
200.  0176  018A          XORWF  ACCB,W
201.  0177  0035          MOVWF  SIGN
202.  0200  07EA          BTFSS  ACCB,7
203.  0201  0A87          GOTO   TRYA
204.
205.  0202  026B          COMF   ACCB+1            ;NEGB, CAN'T CALL SUBR
206.  0203  02AB          INCF   ACCB+1
207.  0204  0643          BTFSC  ASR,2             ;SKIP ON NO ZERO
208.  0205  00EA          DECF   ACCB
209.  0206  026A          COMF   ACCB
210.  0207  07E7  TRYA    BTFSS  ACCA,7
211.  0210  0B00          RETLW  0
```

```
212.
213.            ;.............................................................
214.            ;
215.            ; NEGA                          .. Negate fA
216.            ;
217.            ;.............................................................
218.
219.  0211  026B  NEGA    COMF   ACCA+1
220.  0212  02A8          INCF   ACCA+1
221.  0213  0643          BTFSC  ASR,2
222.  0214  00E7          DECF   ACCA
223.  0215  0267          COMF   ACCA
224.  0216  0800          RETLW  0
225.
226.            ;.............................................................
227.            ;
228.            ; NORM                          .. Shifts a fp # till it has a 1 in bit 6 of
229.            ;                          .. the MS byte ( This is done to improve
230.            ;                          .. the accuracy)
231.            ;
232.            ;.............................................................
233.
234.  0217  020A  NORM    MOVF   ACCB,W
235.  0220  0E7F          ANDLW  177                ; .. Check for + and - 0 ( 177 0 = 127 H)
236.  0221  0743          BTFSS  ASR,2              ; .. Skip on high byte = 0
237.  0222  0A96          GOTO   CNORM
238.
239.  0223  022B          MOVF   ACCB+1
240.  0224  0643          BTFSC  ASR,2              ; .. Skip if other then 0
241.  0225  0B00          RETLW  0                  ; .. If 0 then return
242.
243.  0226  06CA  CNORM   BTFSC  ACCB,6             ; .. If there's a 1 in bit 6 quit
244.  0227  0B00          RETLW  0
245.
246.  0230  092E          CALL   MASL1              ; .. Shift left
247.  0231  00EC          DECF   EXPB               ; .. Lower the exponent to match the shift
248.  0232  0A96          GOTO   CNORM
249.
250.            ;.............................................................
251.            ;
252.            ; FSWAP                         .. Swap the contents of fA & fB
253.            ;
254.            ;.............................................................
255.
256.  0233  0207  FSWAP   MOVF   ACCA,W
257.  0234  002D          MOVWF  TEMP
258.  0235  020A          MOVF   ACCB,W
259.  0236  0027          MOVWF  ACCA
260.  0237  020D          MOVF   TEMP,W
261.  0240  002A          MOVWF  ACCB
262.  0241  0208          MOVF   ACCA+1,W
263.  0242  002D          MOVWF  TEMP
264.  0243  020B          MOVF   ACCB+1,W
265.  0244  0028          MOVWF  ACCA+1
266.  0245  020D          MOVF   TEMP,W
267.  0246  002B          MOVWF  ACCB+1
268.  0247  0209          MOVF   EXPA,W
269.  0250  002D          MOVWF  TEMP
270.  0251  020C          MOVF   EXPB,W
271.  0252  0029          MOVWF  EXPA
272.  0253  020D          MOVF   TEMP,W
273.  0254  002C          MOVWF  EXPB
274.  0255  0B00          RETLW  0
275.                      END
```

What is claimed is:

1. An ice bank control system for a beverage dispenser comprising:

(a) a refrigeration system including a compressor, a compressor motor, an ice water tank filled with water up to a water level, and ice bank building evaporator coils located in said tank below said water level;

(b) a single solid state temperature sensor including a thermistor mounted in said tank completely below said water level and adjacent to but spaced apart from one of said coils and in contact with an ice bank built by said evaporator coils;

(c) a control circuit including a microprocessor connected to said thermistor solely by an electrical lead for controlling the thickness of the ice bank;

(d) said microprocessor including a memory having a reference value stored therein which reference value represents the resistance of said thermistor at a selected temperature;

(e) said control circuit including means for calculating the resistance of said thermistor and for then comparing said calculated value to said reference value;

(f) said control circuit including means for turning off said compressor motor when the difference between said calculated value and said reference value exceeds a first preselected value and for subsequently turning said compressor motor back on when said difference falls to a second preselected value;

(g) said control circuit including means for varying said first preselected value; and (h) said varying means including means for using a lower temperature during the first pulldown and a higher temperature on all subsequent pulldowns.

2. The system as recited in claim 1 wherein said lower temperature is about 27° F. and said higher temperature is about 29.5° F.

3. The system as recited in claim 1 wherein said control circuit includes a two resistor, one capacitor oscillator and in which said thermistor is one of said resistors.

4. A method for controlling the ice bank in a beverage dispenser comprising the steps of:

(a) providing a refrigeration system including a compressor, a compressor motor, an ice tank filled with water up to a water level, and ice bank building evaporator coils located in said tank below said water level;

(b) providing a single solid state temperature sensor including a thermistor mounted in said tank completely below said water level and adjacent to but spaced apart from one of said coils and in contact with an ice bank built by said evaporator coils;

(c) providing a control circuit including a microprocessor for controlling the thickness of the ice bank;

(d) connecting said control circuit to said sensor solely by an electrical lead;

(e) storing in the memory of said microprocessor a reference value which represents the resistance of said thermistor at a selected temperature;

(f) calculating the resistance of said thermistor and then comparing said calculated value to said reference value;

(g) turning off said compressor motor when the difference between said calculated value and said reference value exceeds a first preselected value and subsequently turning said compressor motor back on when said difference falls to a second preselected value; and (h) varying said first preselected value, said varying step including using a lower temperature during the first pulldown and using a higher temperature on all subsequent pulldowns.

5. The method as recited in claim 4 including the step of providing a two resistor, one capacitor oscillator and using said thermistor as one of said resistors and measuring said temperature by measuring the period of said oscillator.

6. The method as recited in claim 4 wherein said first preselected value is about 29.5° F. and said second preselected value is about 31.5° F.

* * * * *